US008124930B2

(12) United States Patent
Wang

(10) Patent No.: US 8,124,930 B2
(45) Date of Patent: Feb. 28, 2012

(54) MULTIPOLE ION TRANSPORT APPARATUS AND RELATED METHODS

(75) Inventor: Mingda Wang, Fremont, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 280 days.

(21) Appl. No.: 12/479,614

(22) Filed: Jun. 5, 2009

(65) Prior Publication Data

US 2010/0308218 A1 Dec. 9, 2010

(51) Int. Cl.
*H01J 49/00* (2006.01)

(52) U.S. Cl. ..... 250/292; 250/282; 250/290

(58) Field of Classification Search ..... 250/292
See application file for complete search history.

(56) References Cited

U.S. PATENT DOCUMENTS

| | | | | |
|---|---|---|---|---|
| 4,535,235 | A | 8/1985 | McIver, Jr. | |
| 4,963,736 | A | 10/1990 | Douglas et al. | |
| 5,572,035 | A | 11/1996 | Franzen | |
| 5,652,427 | A | 7/1997 | Whitehouse et al. | |
| 5,847,386 | A | 12/1998 | Thomson et al. | |
| 6,107,628 | A * | 8/2000 | Smith et al. | 250/292 |
| 6,111,250 | A * | 8/2000 | Thomson et al. | 250/282 |
| 6,121,607 | A | 9/2000 | Whitehouse et al. | |
| 6,163,032 | A | 12/2000 | Rockwood | |
| 7,358,488 | B2 * | 4/2008 | Chernushevich et al. | 250/288 |
| 7,569,811 | B2 * | 8/2009 | Javahery et al. | 250/282 |
| 2007/0284524 | A1 | 12/2007 | Franzen | |
| 2008/0067365 | A1 | 3/2008 | Thakur et al. | |
| 2008/0217528 | A1 | 9/2008 | Gonin et al. | |
| 2010/0301210 | A1 * | 12/2010 | Bertsch et al. | 250/290 |

FOREIGN PATENT DOCUMENTS

WO 2006059123 A2 6/2006

OTHER PUBLICATIONS

International Search Report and Written Opinion From Corresponding PCT Application No. PCT/US2010/037324, Jan. 24, 2011 (9 pgs).

Guo-Zhong Li and Joseph A. Jarrell, Proc. 46th ASMS Conference on Mass Spectrometry and Allied Topics, Orlando, Florida, 1998, p. 491.

* cited by examiner

*Primary Examiner* — Phillip A Johnston

(57) ABSTRACT

An ion transport apparatus includes an ion entrance end, an ion exit end, and electrodes arranged along a longitudinal axis from the ion entrance end toward the ion exit end. The electrodes are configured for applying an RF electrical field that varies along the longitudinal axis such that at the ion entrance end, the RF electrical field comprises a major first multipole component of $2n_1$ poles where $n_1 \geqq 3/2$, and at the ion exit end the RF electrical field comprises predominantly a second multipole component of $2n_2$ poles where $n_2 \geqq 3/2$ and $n_2 < n_1$.

20 Claims, 14 Drawing Sheets

MULTIPOLE ION TRANSPORT APPARATUS AND RELATED METHODS

FIELD OF THE INVENTION

The present invention relates generally to the guiding of ions which finds use, for example, in fields of analytical chemistry such as mass spectrometry. More particularly, the present invention relates to the guiding of ions in a converging ion beam.

BACKGROUND OF THE INVENTION

An ion guide (or ion transport apparatus) may be utilized to transmit ions in various types of ion processing devices, one example being a mass spectrometer (MS). The theory, design and operation of various types of mass spectrometers are well-known to persons skilled in the art and thus need not be detailed in the present disclosure. A commonly employed ion guide is based on a multipole electrode structure in which two or more pairs of electrodes are elongated in the direction of the intended ion path and surround an interior space in which the ions travel. Typically, the electrode structure is an RF-only electrode structure in which the ions passing through the ion guide are subjected to a two-dimensional, radio-frequency (RF) trapping field that focuses the ions along an axial path through the electrode structure. The paths of the ions are able to oscillate in radial directions in the transverse plane that is orthogonal to the axis of the electrode structure, but these oscillations are limited by the forces imparted by the RF electrical field being applied in the transverse plane. As a result, the ions are confined to an ion beam centered around the axis of the electrode structure (which typically is a geometrically centered axis). In the absence of the RF field, the ions would be widely dispersed in an unstable, uncontrolled manner. Few ions would actually be transmitted to a subsequent device from the ion exit of the ion guide; most ions would not reach the ion exit but instead hit the ion guide rods or escape from the electrode structure. Therefore, in an ion guide the ions need to experience a certain minimum amount of RF restoring force during their flight so as to be confined to an ion beam for efficient transmission to and beyond the ion exit at the axial end of the ion guide.

In a conventional ion guide, the applied RF electrical field is generally uniform along the axial direction from the ion entrance to the ion exit, disregarding fringe effects and other localized discontinuities. As a result, the ion beam is generally cylindrical at least in the sense that the cross-sectional area of the ion beam—generally representing the envelope in which radial excursions of the ions are limited in the two-dimensional plane—is uniform along the axis. The size of the cross-section of the ion beam generally depends on the nature of the RF field being applied. As examples, a set of four parallel electrodes may be utilized to generate a quadrupolar RF field, a set of six parallel electrodes may be utilized to generate a hexapolar RF field, etc. In a quadrupolar field, the ions are focused more strongly about the axis and hence the cross-section of the ion beam is smaller as compared to a hexapolar field. In all such conventional cases the RF field and therefore the cross-section of the ion beam are uniform. However, the conditions under which ions of a given mass-to-charge (m/z) ratio or range of m/z ratios can be admitted into the ion guide in an optimal manner are not necessarily the same as the conditions under which ions can be emitted from the ion guide in an optimal manner. Consequently, the dimensions of a uniform ion beam are often not optimal for both ion entry and ion exit, or even for either ion entry or ion exit alone, leading to less than optimal ion signal and instrument sensitivity.

Accordingly, there is a need for ion transport devices configured for providing optimized ion transmission conditions for ions of a wide range of m/z ratios.

SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, an ion transport apparatus includes an ion entrance end, an ion exit end disposed at a distance from the ion entrance end along a longitudinal axis, an ion entrance section extending along the longitudinal axis from the ion entrance end toward the ion exit end, an ion exit section extending along the longitudinal axis from the ion exit end toward the ion entrance end, and a plurality of electrodes. The electrodes are arranged along the longitudinal axis wherein at least portions of the electrodes are disposed at a radial distance in a transverse plane orthogonal to the longitudinal axis. The plurality of electrodes includes a plurality of first electrodes circumscribing an interior space in the ion entrance section and a plurality of second electrodes circumscribing an interior space in the ion exit section. The plurality of electrodes is configured for applying an RF electrical field that varies along the longitudinal axis such that at the ion entrance end, the RF electrical field includes a first RF electrical field including a major first multipole component of $2n_1$ poles where $n_1 \geqq 3/2$, and at the ion exit end the RF electrical field includes a second RF electrical field including predominantly a second multipole component of $2n_2$ poles where $n_2 \geqq 3/2$ and $n_2 < n_1$.

According to another implementation, at least some of the electrodes have a cross-sectional area in a transverse plane orthogonal to the longitudinal axis wherein the cross-sectional area is different at the ion entrance end than at an opposite axial end of the at least some electrodes.

According to another implementation, a method is provided for transporting ions. The ions are admitted into an interior space of an ion transport apparatus at an axial ion entrance end thereof. The ion transport apparatus includes a plurality of electrodes arranged along a longitudinal axis from the axial ion entrance end toward an axial ion exit end, wherein the plurality of electrodes surrounds the interior space in a transverse plane orthogonal to the longitudinal axis. Radial motions of the ions in the transverse plane are constrained to a converging ion beam that extends along the longitudinal axis from a large ion beam cross-section at the ion entrance end to a small ion beam cross-section at the ion exit end. The converging ion beam is effected by applying an RF electrical field that varies along the longitudinal axis such that at the ion entrance end, the RF electrical field comprises a major first multipole component of $2n_1$ poles where $n_1 \geqq 3/2$, and at the ion exit end the RF electrical field comprises predominantly a second multipole component of $2n_2$ poles where $n_2 \geqq 3/2$ and $n_2 < n_1$.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

The subject matter disclosed herein generally relates to the transmission of ions and associated ion processing. Examples of implementations of methods and related devices, apparatus, and/or systems are described in more detail below with reference to FIGS. 1-19. These examples are described at least in part in the context of mass spectrometry (MS). However, any process that involves the transmission of ions may fall within the scope of this disclosure.

Figure 1:
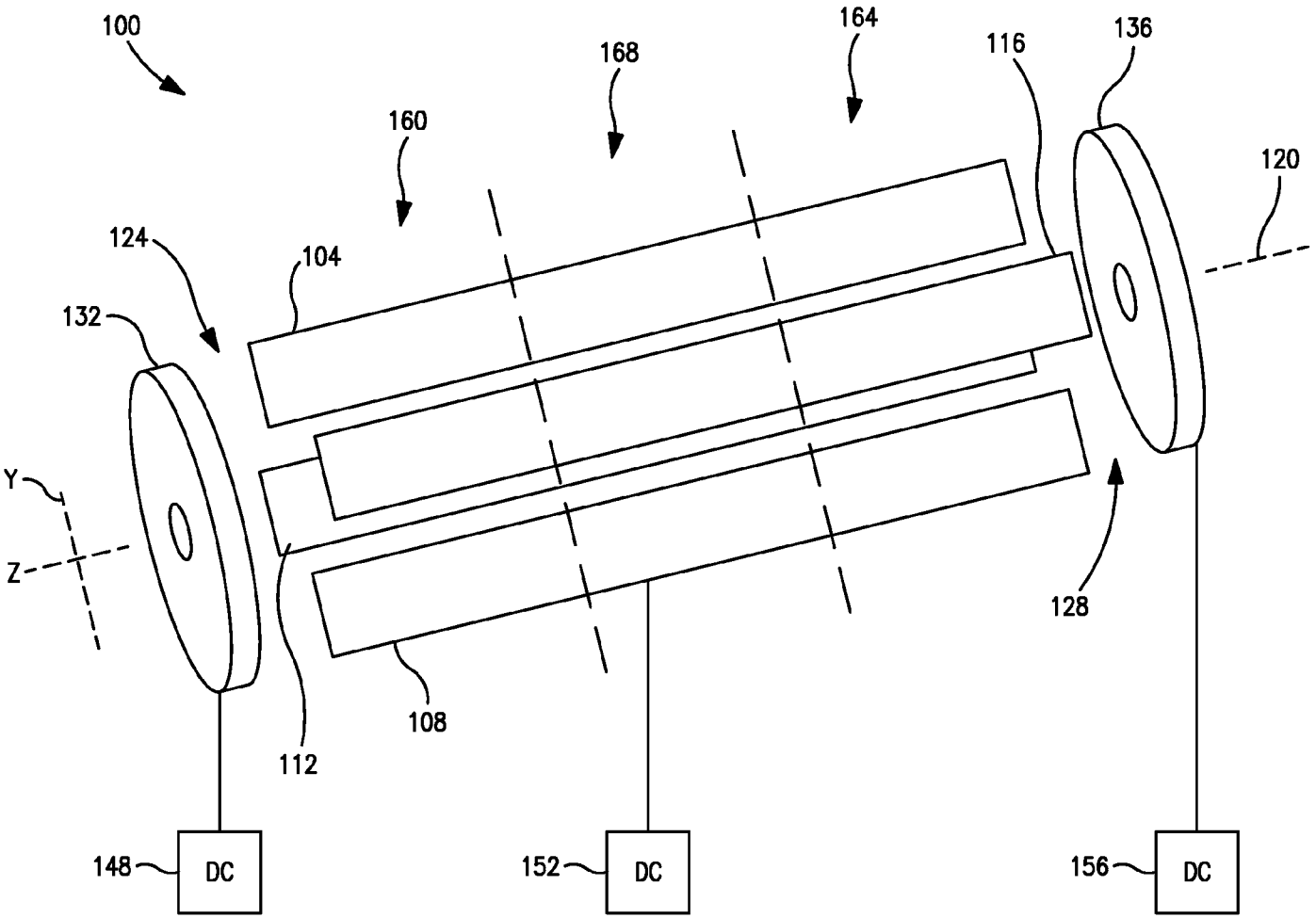
FIG. 1 is a simplified perspective view of an example of an ion transport apparatus according to certain implementations of the present disclosure.

FIG. 1 is a simplified perspective view of an example of an ion transport apparatus (device, assembly, etc.) 100 according to certain implementations of the present disclosure. The ion transport apparatus 100 includes a plurality of electrodes 104, 108, 112, 116 arranged about a longitudinal axis 120, which may be referred to as the z-axis. The electrodes 104, 108, 112, 116 are arranged so as to circumscribe an interior space within the ion guide 100 such that the interior space also is elongated along the longitudinal axis 120. At least a portion of each electrode 104, 108, 112, 116 is disposed at a radial distance from the longitudinal axis 120 in the transverse or x-y plane that is orthogonal to the longitudinal axis 120. Hence, the electrodes 104, 108, 112, 116 and the interior space have respective cross-sectional areas in the transverse plane and an axial dimension along the longitudinal axis 120. The cross-sectional area of the interior space is generally bounded by the surfaces of the electrodes 104, 108, 112, 116 that face inward toward the interior space. The opposing axial ends of the electrodes 104, 108, 112, 116 respectively surround an axial ion entrance end 124 and an axial ion exit end 128 of the ion transport apparatus 100. The ion guide 100 may generally include a housing or frame (not shown) or any other structure suitable for supporting the electrodes 104, 108, 112, 116 in a fixed arrangement along the longitudinal axis 120. Depending on the type of ion processing system contemplated, the housing may provide an evacuated, low-pressure, or less than ambient-pressure environment. As appreciated by persons skilled in the art, upon the proper application of RF voltages to the electrodes 104, 108, 112, 116, the electrodes 104, 108, 112, 116 generate a two-dimensional (x-y plane in the present example), multipolar, RF electrical restoring field that focuses ions generally along a path or ion beam directed along the longitudinal axis 120, as described further below in conjunction with FIG. 3. The ions are constrained to motions in the transverse plane in the vicinity of the longitudinal axis 120, such that the ion beam may be considered to be an ion cloud or ion-occupied transport region focused along the longitudinal axis 120 from the ion entrance end 124 to the ion exit end 128.

The ion transport apparatus 100 may further include one or more ion entrance lenses 132 positioned at one or more axial distances before the ion entrance end 124, and one or more ion exit lenses 136 positioned at one or more axial distances after the ion exit end 128. The ion entrance lens 132 and the ion exit lens 136 may be any suitable structures, such as plates, disks, cylinders or grids with respective apertures. The ion transport apparatus 100 may include a device or means for generating one or more electrical fields utilized to control ion energy in the axial direction. These devices or means may be embodied in one or more DC voltage sources or signal generators. Thus, in the illustrated example, respective DC voltage sources 148, 152, 156 may be placed in electrical communication with the ion entrance lens 132, the electrodes 104, 108, 112, 116, and the ion exit lens 136 to generate axial DC potentials across the axial gap between the ion entrance lens 132 and the electrodes 104, 108, 112, 116 and across the axial gap between the electrodes 104, 108, 112, 116 and the ion exit lens 136. In this manner, ions may be guided and urged into the ion transport apparatus 100 through the ion entrance end 124 and out from the ion transport apparatus 100 through the ion exit end 128. It will be understood that the DC voltage sources 148, 152, 156 are schematically represented in FIG. 1 and in practice may be implemented by various different types of physical circuitry or devices. As one alternative, an external axial DC field-generating device or devices (not shown) may be implemented, such as one or more other conductive structures (e.g., resistive traces, wires, etc.) positioned along the longitudinal axis 120.

In various implementations, the ion transport apparatus 100 may include a plurality of ion transport sections. Each ion transport section may be distinguished from the other sections by the configuration of the electrodes 104, 108, 112, 116 or the composition of the RF multipole electrical field applied in that section. The ion transport apparatus 100 may include an ion entrance section (or first ion transport section) 160 extending from the ion entrance end 124 toward the ion exit end 128, and an ion exit section (or second ion transport section) 164 extending from the ion exit end 128 toward the ion entrance end 124. In some implementations, the ion transport apparatus 100 may further include one or more intermediate sections (or third ion transport section, fourth ion transport section, and so on) 168 interposed between the ion entrance section 160 and the ion exit section 164. In FIG. 1, the ion entrance section 160, ion exit section 164 and intermediate section 168 are schematically demarcated by dashed lines. No limitation is placed on the respective axial lengths of these ion transport sections 160, 164, 168 relative to each other. Some or all of the electrodes 104, 108, 112, 116 may extend through each section 160, 164, 168.

In the example specifically illustrated in FIG. 1, the electrodes 104, 108, 112, 116 are provided in the form of a set of straight rods. In this case, the electrodes 104, 108, 112, 116 may be generally parallel to each other and to the longitudinal axis 120, circumferentially spaced from each other about the longitudinal axis 120, and elongated along the longitudinal axis 120. In other implementations, examples of which are described below, the electrodes 104, 108, 112, 116 may have rectilinear, square or other polygonal cross-sections, or may be provided in the form of helices coiled around the longitudinal axis 120, or may be provided in the form of a series or stack of rings axially spaced along the longitudinal axis 120. Moreover, in general no limitation is placed on the number of electrodes 104, 108, 112, 116, so long as the electrodes 104, 108, 112, 116 are configured to generate a two-dimensional RF electrical field in the interior space to control the ion beam in the manner disclosed herein. In some implementations, the electrode set includes at least two opposing pairs of electrodes corresponding to a quadrupolar arrangement of electrodes. Thus in FIG. 1, relative to the longitudinal axis 120, one electrode 104 is located radially opposite to another electrode 108 (such as along the y-axis) and another electrode 112 is located radially opposite to yet another electrode 116 (such as along the x-axis). In other implementations, more than four electrodes may be provided as for example in hexapolar, octopolar, decapolar and dodecapolar arrangements, as well as arrangements including more than twelve electrodes. In still other implementations such as in the case of helical electrodes, as few as two electrodes may be utilized.

Figure 2:
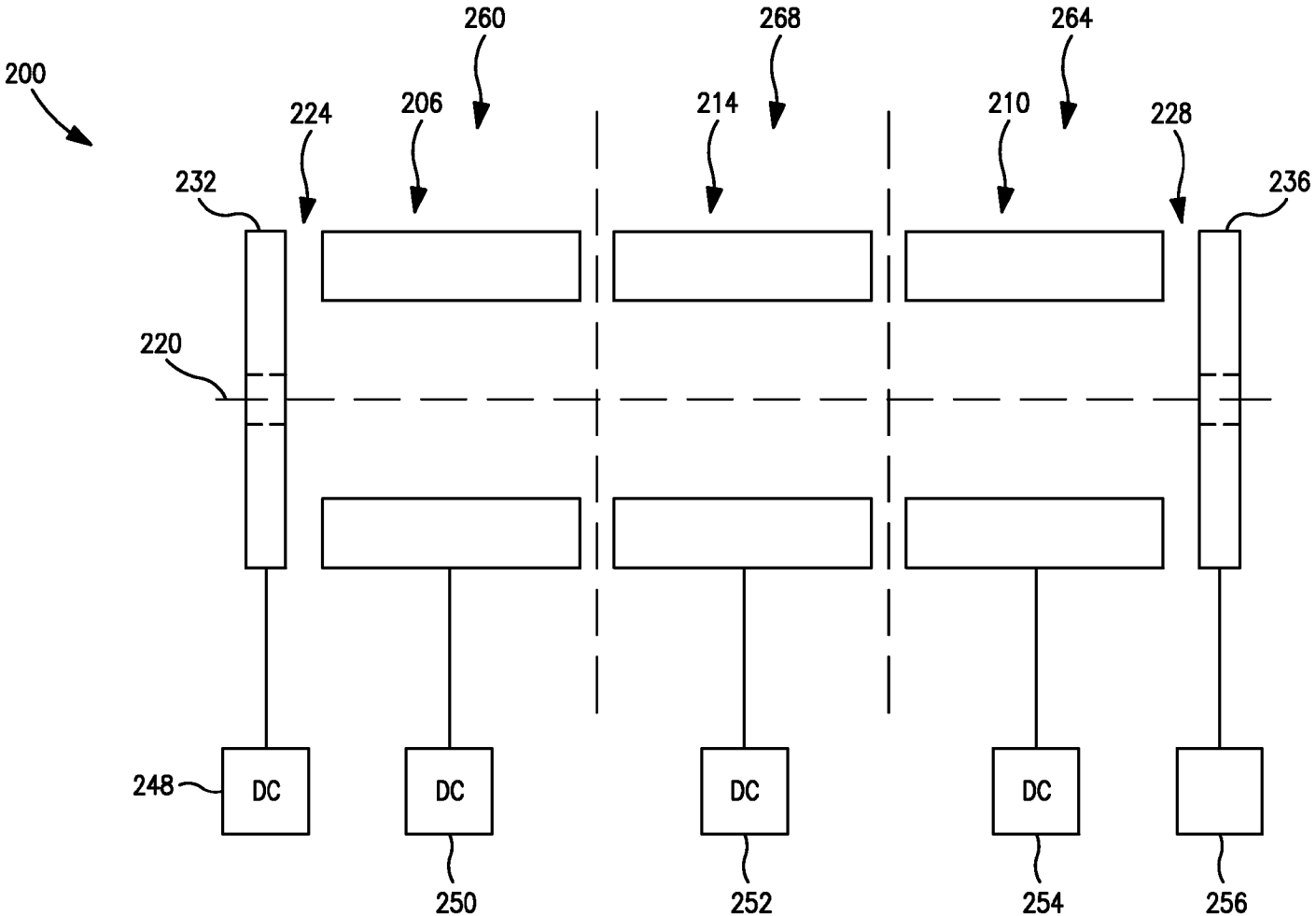
FIG. 2 is a side (length-wise) view of another example of an ion transport apparatus according to other implementations of the present disclosure.

FIG. 2 is a side (length-wise) view of another example of an ion transport apparatus 200 according to other implementations of the present disclosure. For clarity, only a partial arrangement of radially opposing pairs of electrodes is illustrated. This ion transport apparatus 200 may be considered as comprising a series of multipole ion transport devices arranged along a longitudinal axis 220, or as having a segmented electrode configuration. The ion transport apparatus 200 includes a first set 206 of electrodes corresponding to an ion entrance section 260 and a second set 210 of electrodes corresponding to an ion exit section 264. The ion transport apparatus 200 may further include one or more other sets 214 of electrodes corresponding to one or more intermediate sections 268. The interior space circumscribed by the first set 206 of electrodes may be referred to as an ion entrance region (or first ion transport region), the interior space circumscribed by the second set of electrodes 210 may be referred to as an ion exit region (or second ion transport region), the interior space circumscribed by the third set 214 of electrodes may be referred to as an intermediate region (or third ion transport region), and so on. The sets 206, 214, 210 of electrodes are separated by axial gaps in this example. One or more ion entrance lenses 232 and ion exit lenses 236 may also be included. As schematically depicted in FIG. 2, respective DC voltage sources 248, 250, 252, 254, 256 may be placed in electrical communication with the ion entrance lenses 232, the electrode sets 206, 214, 210, and the ion exit lenses 236, to drive ions into, through and out from the ion transport apparatus 200.

Figure 3:
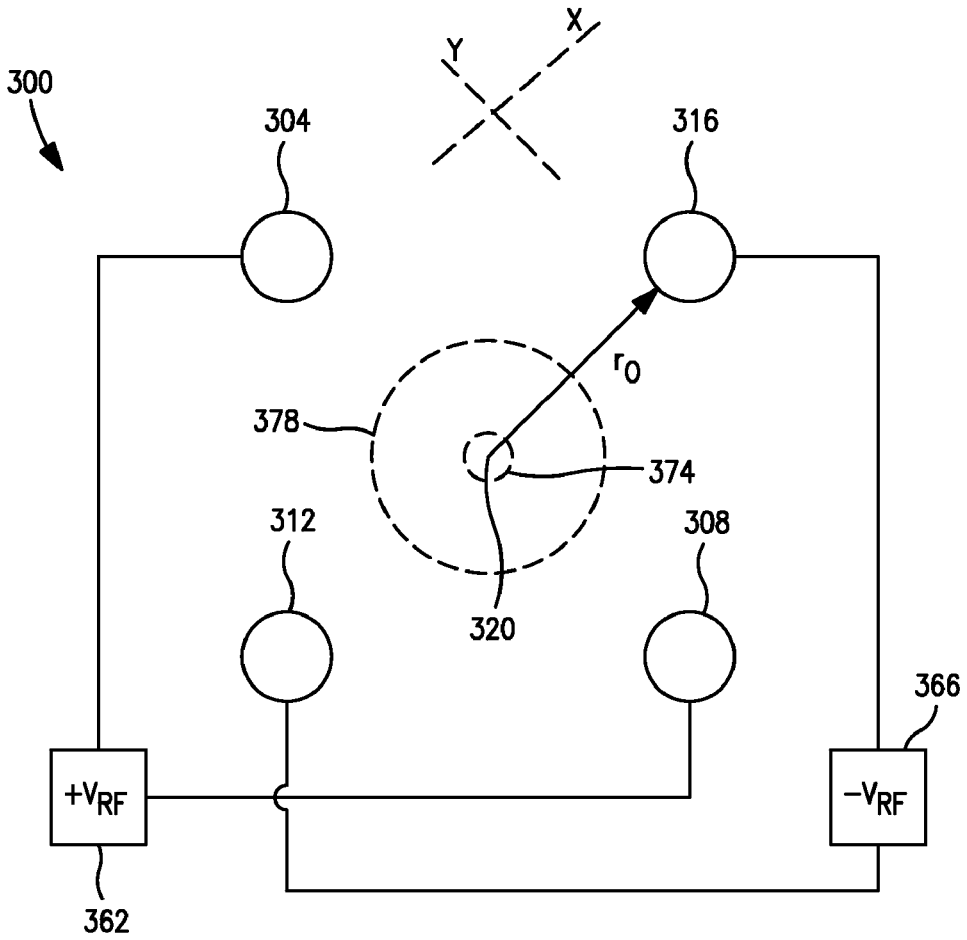
FIG. 3 is a schematic end view of an electrode set of an ion transport apparatus at its ion entrance end.

FIG. 3 is a schematic end view, in the transverse or x-y plane, of an electrode set of an ion transport apparatus 300 at its ion entrance end. The electrode set may correspond to the electrode set illustrated in FIG. 1 or to the first electrode set 206 illustrated in FIG. 2. In this example, the electrode set includes a first pair of opposing electrodes 304, 308 and a second pair of opposing electrodes 312, 316. Typically, the opposing pair of electrodes 304 and 308 is electrically interconnected, and the other opposing pair of electrodes 312 and 316 is electrically interconnected, to facilitate the application of appropriate RF voltage signals that drive the two-dimensional ion guiding field. Each electrode 304, 308, 312 and 316 is typically spaced at the same radial distance $r_0$ from a longitudinal z-axis 320 as the other electrodes 304, 308, 312 and 316. Thus, the interior space of the ion transport apparatus 300 is generally bounded in the transverse plane by a circle of inscribed radius $r_0$. The interior space of the ion transport apparatus 300, and the ion guiding region in which two-dimensional (radial) excursions of the ions are constrained by the applied RF focusing field, are generally defined within this inscribed circle.

The ion transport device 300 includes a device or means for generating one or more two-dimensional RF electrical fields in one or more corresponding ion transport regions to constrain ions to a converging ion beam as described in more detail below. These devices or means may be embodied in one or more RF (or RF/DC) voltage sources or signal generators. Thus, in the illustrated example, to generate the ion focusing or guiding field(s), a radio frequency (RF) voltage of the general form $V_{RF}\cos(\Omega t)$ is applied to opposing pairs of interconnected electrodes 304, 308 and 312, 316, with the signal applied to the one electrode pair 304, 308 being 180 degrees out of phase with the signal applied to the other electrode pair 312, 316. In FIG. 3, application of the RF energy is schematically depicted by an RF voltage source ($+V_{RF}$) 362 in signal communication with the first pair of electrodes 304, 308 and another RF voltage source ($-V_{RF}$) 366 in signal communication with the second pair of electrodes 312, 316. In a segmented ion transport apparatus such as illustrated in FIG. 2, each electrode pair in each section may be interconnected and RF voltages applied thereto in a similar manner. In implementations where it is desired that the ion transport device 300 function as a mass filter or mass sorter, appropriate DC voltages ($\pm U$) may be superposed on the RF voltages ($\pm V_{RF}$) being applied. These DC voltages are not to be confused with the above-noted axial DC potentials utilized to create axial DC fields. The basic theories and applications respecting the generation of multipole RF fields for ion focusing, guiding or trapping, as well as for mass filtering, ion fragmentation, ion ejection, ion isolation and other related processes, are well known and thus need not be detailed here.

In the examples given in FIGS. 1-3, the electrode set consists of four electrodes arranged in parallel and in opposing, electrically interconnected pairs. If a two-dimensional RF confining field is conventionally applied to this electrode set, the result is a pure, symmetrical, quadrupolar RF field where the number of poles of the electrical field is 2n and n=2. In the present context, a "pure" or "predominant" quadrupolar RF field is taken to mean that no major (or significant) higher-order multipole RF fields are present (intentionally or unintentionally) in combination with the quadrupolar field. Examples of higher-order RF fields include, but are not limited to, hexapolar fields (n=3), octopolar fields (n=4), decapolar fields (n=5), and dodecapolar fields (n=6). Generally, the field strength of a higher-order multipole RF field or fields is "major" if it enables a larger ion beam cross-section to be maintained in a given space as compared to the ion beam cross-section that would result from a lower-order multipole RF field applied to the same space.

In the present context, "major" higher-order multipole RF fields may also be characterized as superimposing a substantial fraction of the field strength onto the lower-order (e.g., quadrupolar) field being applied in a particular ion transport region of the ion transport apparatus. As an example, consider that in a given ion transport region a composite RF field is present and is characterized as comprising a combination of a quadrupolar field component and one or more higher-order multipole field components. For the higher-order multipole field component or components to be major, the higher-order multipole RF field (or plurality of fields in a case where more than one type of higher-order multipole field is superposed) may have a strength that is 10% or greater of the strength of the quadrupolar field being applied. Therefore, in a pure or predominant quadrupolar RF field, if there are any higher-order multipole fields present, the collective strength of these higher-order multipole fields is less than 10% of the strength of the quadrupolar field.

For convenience, then, the term "pure" as used herein encompasses both "pure" (100% field strength) and "predominant" or "substantially pure" (greater than 90% field strength). The term "pure" also takes into account that in practical implementations, relatively weak (and sometimes very localized) higher-order multipole fields may be present unintentionally or unavoidably due to field faults, fringe effects or distortions resulting from machining and assembly imperfections, from the presence of apertures or other geometric discontinuities in the electrodes, from the necessarily finite size of the electrodes (i.e., real electrodes are truncated; their surfaces do not infinitely extend toward the asymptotic lines of the perfect hyperbolic geometry that would result in a purely quadrupolar electric field), from the use of electrodes having surfaces deviating from the ideal hyperbolic geometry (e.g., cylindrical rods, rectilinear bars or plates, etc.), space-charge effects, etc.

In a pure quadrupolar field, the ion beam is concentrated relatively tightly about the longitudinal axis about which the electrodes are arranged and thus is shaped approximately as an elongated cylinder. Moreover, again in a conventional quadrupole rod arrangement, the quadrupole RF field active in the interior space of the electrode set is generally uniform along the length of the electrode set (i.e., from ion entrance end to ion exit end). Thus, the cross-sectional area of the ion beam-i.e., the limits of the excursions of the ions in the transverse plane-is generally uniform or constant from the ion entrance end to the ion exit end. That is, the ion beam has a generally cylindrical shape of constant cross-sectional area as opposed to being conical or funnel-shaped. Stated yet another way, the cross-sectional area of the ion beam does not appreciably diverge or converge. Similarly, if a two-dimensional RF focusing field is conventionally applied to an electrode set consisting of six parallel rods, the result would be a hexapolar RF field. The resulting ion beam would again have a generally cylindrical shape of constant cross-sectional area from the ion entrance end to the ion exit end. However, the cross-sectional area of an ion beam in a hexapolar field will be larger than it would be in a pure quadrupolar field. Similar results obtain for yet higher-order RF fields. In all such conventional cases, the ion beam neither converges nor diverges.

FIG. 3 schematically depicts the cross-sectional area 374 of an ion beam in a lower-order field such as a quadrupole in comparison to the cross-sectional area 378 of an ion beam in a higher-order field such as a hexapole, octopole, etc. It will be appreciated by persons skilled in the art that these dashed-line circles are provided to generally demarcate the envelope in which the ions of the ion beam travel in the transverse plane. In practice, the actual cross-sectional area of the ion beam may have a more elliptical shape, with the orientation of the ellipse varying in the x-y plane in accordance with the cycle of RF energy being applied.

In contrast to the above-described conventional RF field which has a generally constant composition along the longitudinal axis, in accordance with the present teachings, the electrode set and/or the means for applying the RF voltages to the electrode set are configured such that the RF field varies along the longitudinal axis. In various implementations described herein, the RF field varies from comprising a major higher-order multipole field component at the ion entrance end to comprising a predominantly lower-order multipole field component at the ion exit end. In the present context, the terms "higher" and "lower" are taken to be relative to each other. Thus, if the number of poles in the higher-order multipole field is taken to be $2n_1$ and the number of poles in the lower-order multipole field component is taken to be $2n_2$, then $n_1>n_2$. As a result of the axially varying RF field, the ion beam converges in the direction of the ion exit end and thus is generally cone-shaped or funnel-shaped. This convergence may be manifested in a gradual (e.g., tapering) manner, in a step-wise manner, or in a combination of both gradual and step-wise attributes.

Figure 4:
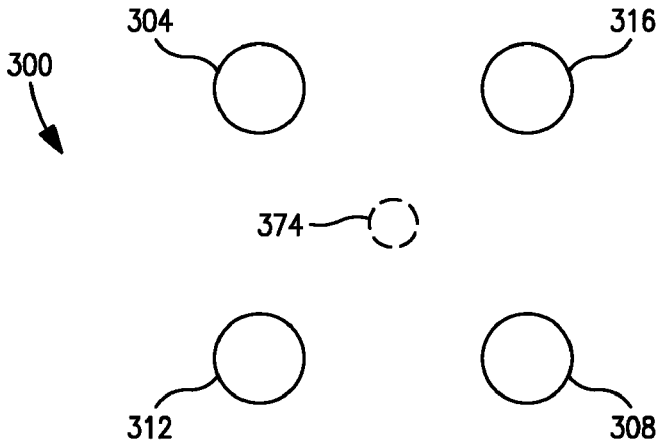
FIG. 4 is a schematic end view of the same electrode set illustrated in FIG. 3 but at the opposite, ion exit end of the ion transport apparatus.

The converging ion beam may be visualized by comparing FIG. 3 to FIG. 4. For this purpose, FIG. 3 may be considered as schematically depicting an ion beam of cross-sectional area 378 under the influence of a higher-order multipole RF field at the ion entrance end. At this axial position, the cross-sectional area 378 of the ion beam may be referred to as the ion entrance aperture or ion acceptance aperture. FIG. 4 is a schematic end view, in the transverse or x-y plane, of the same electrode set illustrated in FIG. 3 but at the opposite, ion exit end of the ion transport apparatus 300. FIG. 4 may be considered as depicting the same ion beam as in FIG. 3, but at the ion exit end where the ion beam now has a smaller cross-sectional area 374 due to the greater focusing influence of the lower-order multipole RF field at this axial position. At the ion exit end, the cross-sectional area 374 of the ion beam may be referred to as the ion exit aperture or ion emission aperture.

Figure 5:
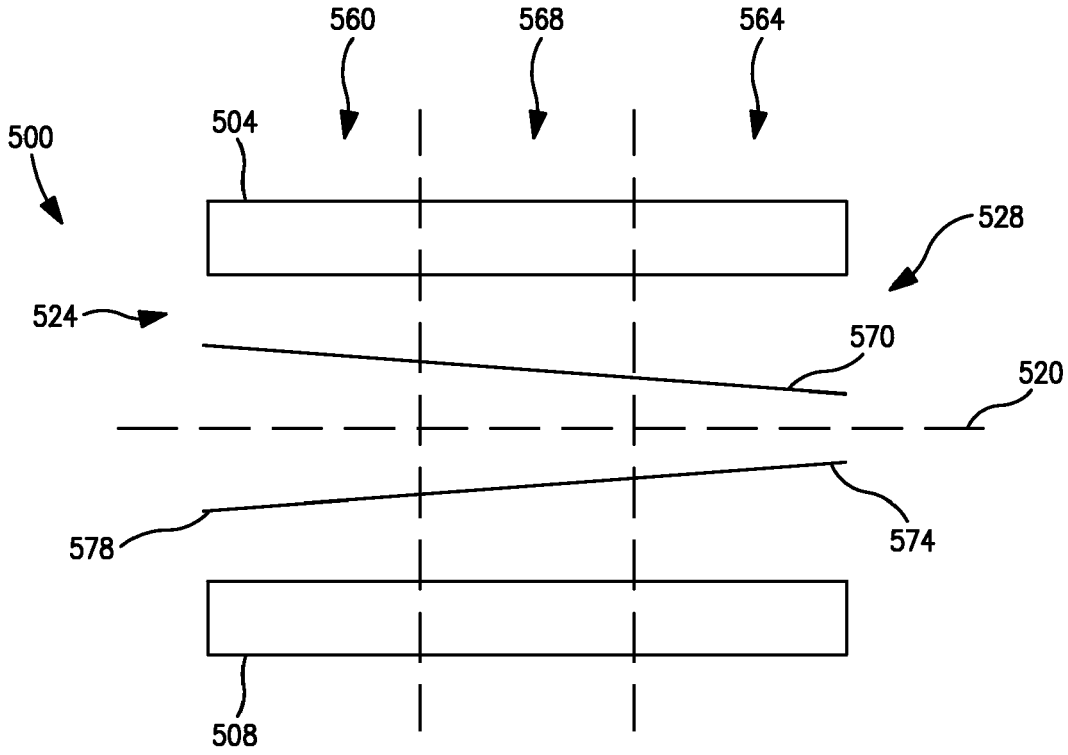
FIG. 5 is a cross-sectional side (length-wise) view of an example of an ion transport apparatus according to other implementations.

The converging ion beam may be further visualized in FIG. 5, which is a cross-sectional side (length-wise) view of an example of an ion transport apparatus 500 along its longitudinal axis 520. For simplicity, a single pair of opposing electrodes 504, 508 is illustrated along with an ion beam 570 in the interior space between these electrodes 504, 508. The ion beam 570 converges in the direction of ion transfer, from a relatively larger (or wider) ion acceptance aperture 578 to a relatively smaller (or narrower) ion emission aperture 574. In this example, the ion beam 570 converges in a gradual or tapered manner from an ion entrance end 524 to an ion exit end 528, and optionally through one or more distinct ion transport sections 560, 564, 568.

Figure 6:
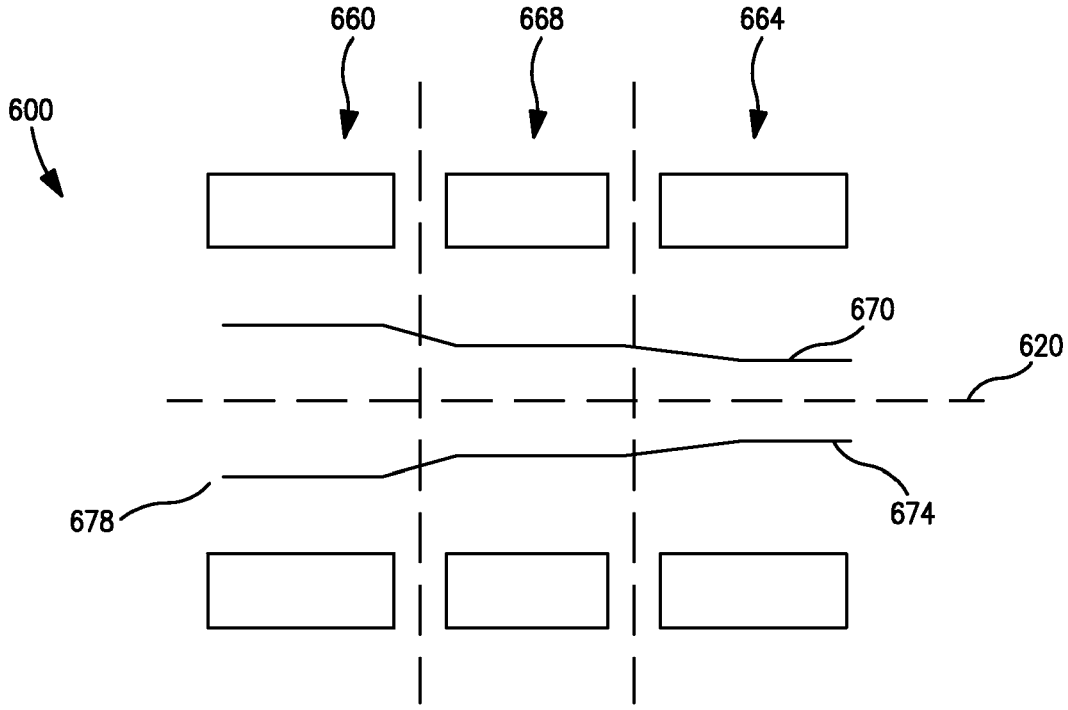
FIG. 6 is a cross-sectional side (length-wise) view of an example of another ion transport apparatus according to other implementations.

By comparison, FIG. 6 is a cross-sectional side (lengthwise) view of an example of another ion transport apparatus 600 along its longitudinal axis 620. In this example, electrodes of the ion transport apparatus 600 are segmented whereby the ion transport apparatus 600 includes an ion entrance section 660, an ion exit section 664, and optionally one or more intermediate sections 668, each of which are axially spaced from the others. Also illustrated is an ion beam 670 that converges in the direction of ion transfer from a larger ion acceptance aperture 678 to smaller ion emission aperture 674. In this example, the ion beam 670 converges in a step-wise manner.

Other implementations may include various combinations of the features or aspects described above and illustrated in FIGS. 5 and 6, depending on the configuration of the electrode set and/or the means for applying the RF field(s). Thus, for instance, the non-segmented electrode set shown in FIG. 5 may apply the step-wise converging ion beam 670 shown in FIG. 6. Alternatively, the segmented electrode set shown in FIG. 6 may apply the gradually converging ion beam 570 shown in FIG. 5. Moreover, while the size of step-wise ion beam 670 is illustrated in FIG. 6 as being constant or substantially constant over the length of each ion transport section 660, 664, 668, the ion beam may alternatively have a hybrid tapering/stepped convergence. For example, the cross-sectional area of the ion beam may taper down along the length of the first ion entrance section 660, then step down to an even more reduced area at the beginning of the next ion transport section 668, then taper down along the length of this section 668, then down to an even more reduced area at the beginning of the next ion transport section 664, and so on. Hence, the composition of the RF electric field applied to the electrode set in either FIG. 5 or FIG. 6 may be (substantially) uniform through a given ion transport section and only appreciably change in an adjacent ion transport section, or alternatively may vary gradually throughout the axial extent of two or more ion transport sections defined for the ion transport apparatus.

An axially varying RF field according to the present disclosure may be characterized as including at least a major higher-order RF multipole field at the ion entrance end (or in the ion entrance section) and a predominantly lower-order RF multipole field at the ion exit end (or in the ion exit section). Thus, for example, the RF field may include a major dodecapole field at the ion entrance end and may predominantly consist of a quadrupole field at the ion exit end. For many implementations disclosed herein, the applied two-dimensional RF electric field may be considered to be a composite of two or more multipole field components. Thus, for example, the RF field may include a major dodecapole field superposed on a quadrupole field at the ion entrance end, and may predominantly consist of a quadrupole field at the ion exit end. At the ion exit end, the dodecapole field—if it exists at all—is minor or insignificant. Other higher-order multipole field components may exist in any given ion transport section of the ion transport apparatus but such other fields are likewise insignificant. Generally, a higher-order multipole field is major if it is strong enough to maintain an enlarged ion beam cross-section in comparison to a lower-order multipole field. As described above, the significance of the higher-order multipole field may be quantified in one non-limiting example by stating that the strength of the higher-order multipole field is 10% or greater of the strength of the lower-order field being applied at the ion exit end. In addition to the major higher-order multipole field applied at the ion entrance end and any major higher-order multipole field applied at an intermediate ion transport section, other higher-order multipole field components may exist in any given ion transport section of the ion transport apparatus. Such other fields, however, may be insignificant (i.e., weak), generally meaning that they do not appreciably affect the intended varying cross-section of the ion beam.

The axially varying RF field giving rise to the converging ion beam may be realized by various combinations of multipole field components. As a few examples, the ion entrance section may include a dodecapole field while the ion exit section includes an octopole, hexapole or quadrupole field. As further examples, the ion entrance section may include an octopole field while the ion exit section includes a hexapole or quadrupole field. As another example, the ion entrance section may include a hexapole field while the ion exit section includes a quadrupole field. In other examples, the higher-order multipole field that is of significance at the ion entrance section may be of a higher order than dodecapole, i.e., $n>6$. Additional variations are possible when the ion transport apparatus is partitioned so as to include one or more intermediate ion transport sections, whether by means of axial segmentation of the electrode set or by some other electrode configuration. As a few examples, the ion entrance section may include a dodecapole field, an intermediate section may include an octopole or hexapole field, and the ion exit section may include a quadrupole field. As another example, the ion entrance section may include an octopole field, an intermediate section may include a hexapole field, and the ion exit section may include a quadrupole field. As another example, the ion entrance section may include a dodecapole field, an intermediate section may include an octopole field, and the ion exit section may include a hexapole field.

In the above examples, the number of electrodes provided is a multiple of 2. Alternatively, however, the number of electrodes in the electrode set may be an odd number, e.g., 3, 5, 7, etc. Also in the above examples, the lowest-order field mentioned is the quadrupole field. However, the lowest-order field applied at the ion exit end (or in the ion exit section) may be a tripole, i.e., $2n=3$ poles where $n=3/2$. A tripole field may be realized by any suitably configured electrode set. In one non-limiting example, three parallel electrodes are provided (not shown). The electrodes are elongated along the longitudinal axis and symmetrically spaced from each other in the transverse plane about the longitudinal axis, i.e., the electrodes are positioned 120° apart. The respective RF signals applied to the three electrodes differ in phase by 120°.

Accordingly, in some implementations in which the ion transport apparatus includes at least an ion entrance end and an ion exit end, the plurality of electrodes is configured for applying an RF electrical field that varies along the longitudinal axis such that at the ion entrance end (or in an associated ion entrance section), the RF electrical field comprises a major first multipole component of $2n_1$ poles where $n_1>3/2$, and at the ion exit end (or in an associated ion exit section) the RF electrical field comprises predominantly a second multipole component of $2n_2$ poles where $n_2>3/2$ and $n_2<n_1$. In other implementations in which the ion transport apparatus additionally includes at least one intermediate ion transport section, the plurality of electrodes may be configured for applying an RF electrical field that varies along the longitudinal axis such that at the intermediate section, the RF electrical field comprises a major third multipole component of $2n_3$ poles where $n_3>n_2$ and $n_3<n_1$ ($n_1>n_3>n_2$).

From the foregoing, it is evident that implementations of the present teachings may provide improved ion transmission efficiency and focusing for various applications entailing the processing of ions such as mass spectrometry. Advantages are achieved by increasing the ion acceptance aperture at the ion entrance end and decreasing the ion emission aperture at the ion exit end. As compared to conventional ion transport or guide devices, the increased ion acceptance aperture allows a higher number of ions to enter the device from an upstream device (e.g., an ion source, collision cell, etc.), and the decreased ion emission aperture allows the ions to be transferred to a downstream device (e.g., a mass analyzer, collision cell, etc.) with increased efficiency and higher ion signal. By means of the converging ion beam, an ion transport device as disclosed herein is able to direct and focus the dispersive ion beam entering the device into a well-confined ion stream that is optimized for transfer to the next device. Optionally, collisional cooling (or damping) may be utilized to further reduce the space volume taken up by the ion phase at the exit end, thereby further increasing ion transfer efficiency. Collisional cooling typically entails the introduction of an inert background gas (e.g., hydrogen, helium, nitrogen, xenon, argon, etc.) into the interior space of the device by any suitable means known to persons skilled in the art. The ion transport device may operate at atmospheric, near-atmospheric, or sub-atmospheric pressure levels (for example, down to about $10^{-9}$ torr).

Implementations disclosed herein may be further explained by the following observations. The electric potential in multipole RF ion guide may be expressed as follows:

$$V(r, \varphi) = V * \mathrm{COS}(\Omega t)\left(\frac{r}{r_o}\right)^n * \mathrm{COS}(n\varphi), \tag{1}$$

where r is a radial position in the RF electrical field relative to the longitudinal axis, $2r_0$ is the distance between two opposite rods, 2n is the number of rods, V is the amplitude of RF voltage applied to rods, $\phi$ is the phase of the RF voltage, $\Omega$ is the angular frequency of the RF voltage, and t is time.

From equation (1), the pseudo-potential of the RF multipole electric field may be expressed as:

$$V_p(r) = \frac{zn^2e^2V^2}{4m\Omega^2r_o^2}\left(\frac{r}{r_o}\right)^{2n-2}, \tag{2}$$

where m is the mass of the ion, the unit of charge $e=1.602\times 10^{-19}$, and z is the number of the charge of the ions (Guo-Zhong Li and Joseph A. Jarrell, *Proc. 46th ASMS Conference on Mass Spectrometry and Allied Topics, Orlando, Florida,* 1998, *p* 491).

Figure 7:
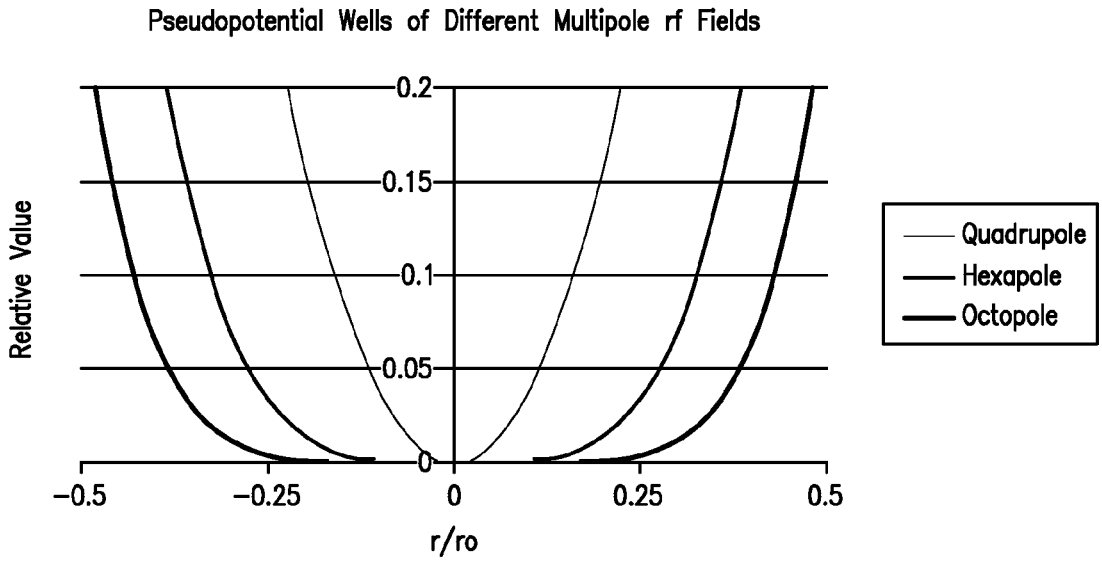
FIG. 7 is a group of plots illustrating the pseudo-potentials of a quadrupole, hexapole, and octopole RF field.
Figure 8:
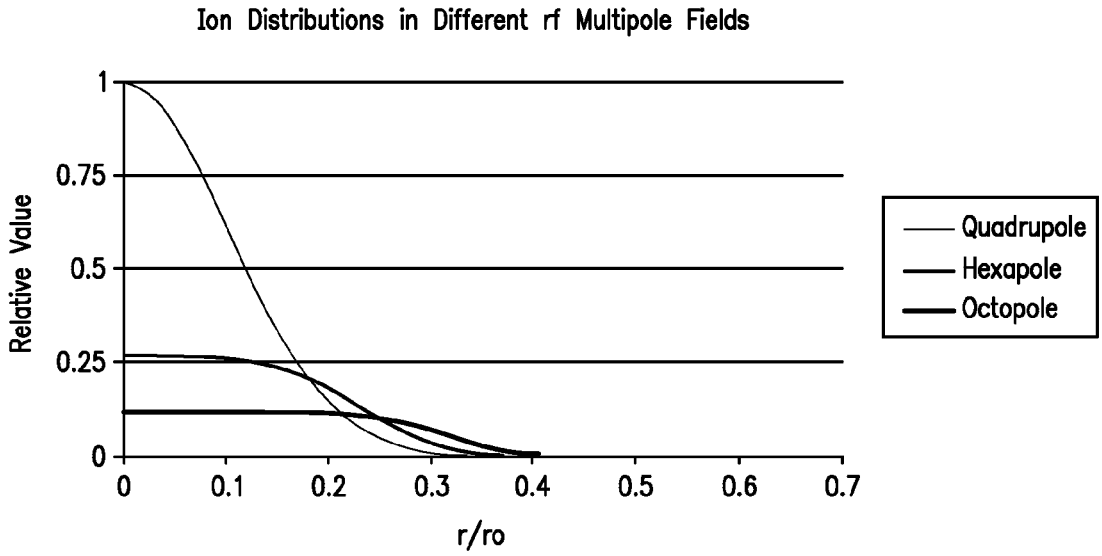
FIG. 8 is a group of plots illustrating ion distributions in a quadrupole, hexapole, and octopole RF field.

FIG. 7 is a group of plots illustrating the pseudo-potentials of a quadrupole, hexapole, and octopole RF field. From FIG. 7, it is clear that acceptance ellipse of a multipole ion guide with a higher number of rods is larger than that of a multipole ion guide with a lower number of rods. FIG. 8 is a group of plots illustrating ion distributions in a quadrupole, hexapole, and octopole RF field, i.e., the radial ion density distributions when ions enter the RF electric field and reach equilibrium. FIG. 8 reveals that the ion radial distribution in a quadrupole (n=2) RF electric field is closer to the central axis than that in a higher-order multipole ($n\geqq 3$) RF electric field. Thus, the ion transferring efficiency from a lower RF electric field, such as quadrupole electric field, to mass analyzer will be higher than that from a higher RF electric field to the mass analyzer. The information presented in FIGS. 7 and 8 indicate that optimal ion transmission through an ion transport apparatus may be attained by providing a higher-order multipole RF field at the ion entrance end and a lower-order multipole RF field at the ion exit end.

Further descriptions of the present teachings are given by way of additional examples set forth below.

Figure 9:
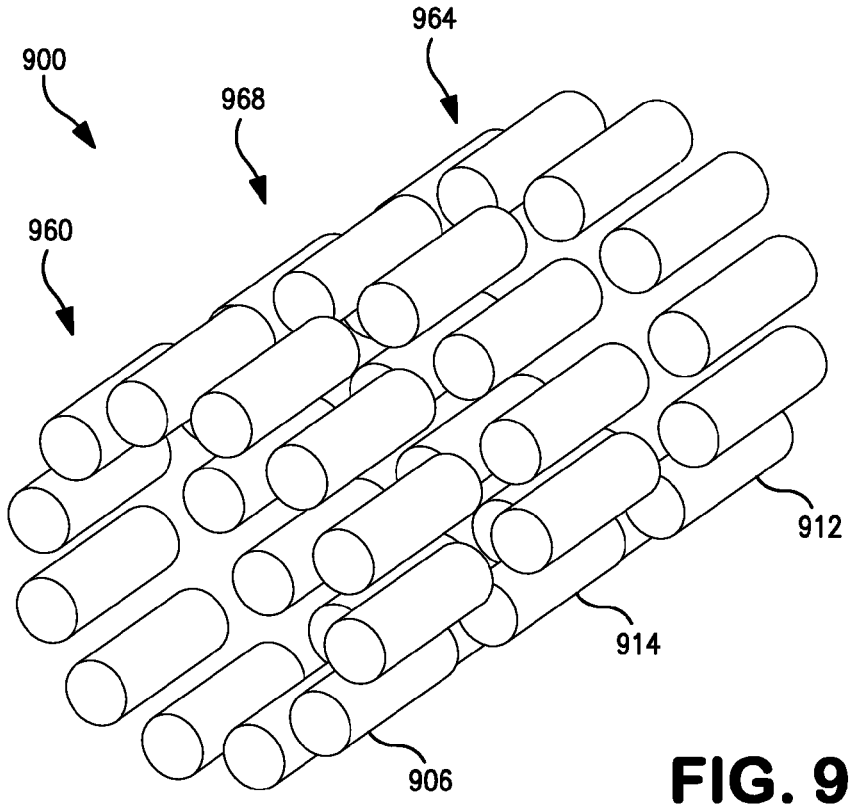
FIG. 9 is a perspective view of an example of ion transport apparatus according to other implementations.

FIG. 9 is a perspective view of an example of ion transport apparatus 900 according to some implementations. The ion transport apparatus 900 includes an ion entrance section 960, an ion exit section 964, and optionally one or more intermediate ion transport sections 968. For simplicity, only one intermediate section 968 is illustrated and described. The ion entrance section 960 includes a first set of electrodes 906, the ion exit section 964 includes a second set of electrodes 910, and the intermediate section 968 if provided includes a third set of electrodes 914. In this example, each section 960, 964, 968 includes the same number of electrodes. The number of electrodes and the manner in which they are structured, and the manner in which RF signals are applied to the electrodes, are such that the ion transport apparatus 900 generates a higher-order multipole RF field in the ion entrance section 960, a lower-order multipole RF field in the ion exit section 964, and another higher-order multipole RF field in the intermediate section 968 (if provided) that is of lower order than the electrical field in the ion entrance section 960 but higher order than the electrical field in the ion exit section 964. By way of example and not by limitation in FIG. 9, each ion transport section 960, 964, 968 includes twelve electrodes, elongated along the longitudinal axis and circumferentially arranged about the longitudinal axis.

Figures 10A, 10B, 10C:
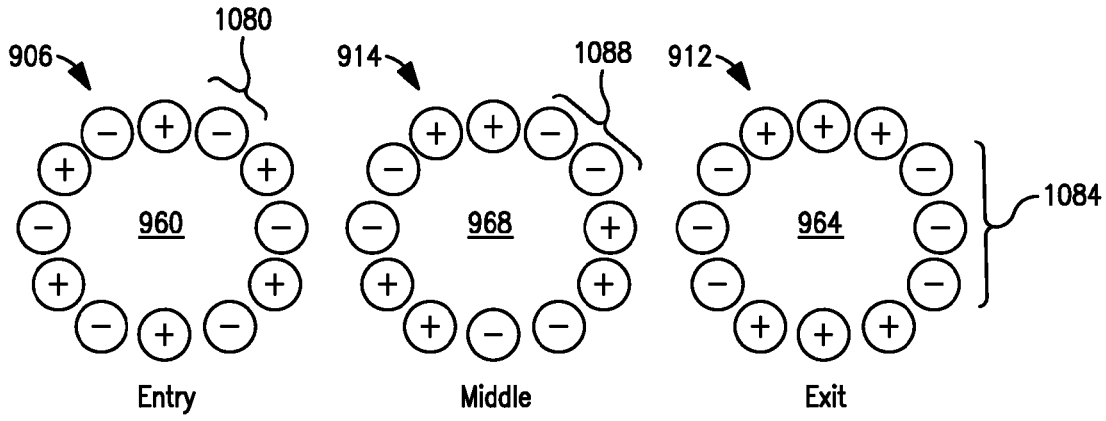
FIGS. 10A, 10B and 10C are schematic cross-sectional views of the electrode sets in the entrance section, intermediate section, and exit section, respectively.

FIGS. 10A, 10B and 10C are schematic cross-sectional views of the electrode sets 906, 914, 912 in the entrance section 960, intermediate section 968, and exit section 964, respectively. FIGS. 10A, 10B and 10C also illustrate how the RF voltages are applied to the electrodes in each respective section 960, 968, 964. One or more of the electrode sets 906, 914, 912 may be divided into groups of m electrodes. In the present example, the number of electrodes in each group 1080 of the first electrode set 906 is $m_1=1$, the number of electrodes in each group 1084 of the second electrode set 912 is $m_2=3$, and the number of electrodes in each group 1088 of the third electrode set 914 is $m_3=2$. Thus, in the example of the twelve-electrode arrangement, the first electrode set 906 includes twelve groups 1080 of one electrode, the second electrode set 912 includes four groups 1084 of three electrodes, and the third second electrode set 914 includes six groups 1088 of two electrodes. Each electrode group 1080, 1084, 1088 is radially positioned in the transverse plane opposite to another electrode group. As indicated by the "+" and "−" signs on the electrodes, the RF voltage applied to each pair of opposing electrodes (or pair of opposing groups 1080, 1084, 1088 of electrodes) is 180° out of phase with the RF voltage applied to the adjacent electrodes (or groups 1080, 1084, 1088 of electrodes) on either side of that pair. The result in the illustrated example is that the first electrode set 906 applies a major dodecapole RF field in the ion entrance region 960, the second electrode set 912 applies a predominant quadrupole RF field in the ion exit region 964, and the third electrode set 914 applies a major hexapole field in the intermediate section 968. The RF field thus varies in the axial direction from a dodecapole RF field to a quadrupole RF field. When the intermediate ion transport section 968 is provided, the RF field varies in the axial direction from a dodecapole RF field, to a hexapole RF field, and then to a quadrupole RF field.

As described in detail earlier in this disclosure, the ion transport apparatus 900 may be modified or configured as needed to generate other types of RF fields in any given ion transport section 960, 964, 968. As an example, an eightelectrode set may be utilized to generate a strong octopole or quadrupole RF field depending on how the electrodes are grouped. As another example, a sixteen-electrode set may be utilized to generate a strong 16-pole, octopole or quadrupole RF field. It will also be understood that a converging ion beam may be realized without requiring that each ion transport section 960, 964, 968 apply a different RF field. As examples, the ion entrance section 960 and any intermediate section 968 adjacent to it could both apply a dodecapole field while the ion exit section 964 applies a quadrupole field, or the ion entrance section 960 could apply a dodecapole field while the ion exit section 964 and any intermediate section 968 adjacent to it could both apply a quadrupole field, and so on.

Figure 11:
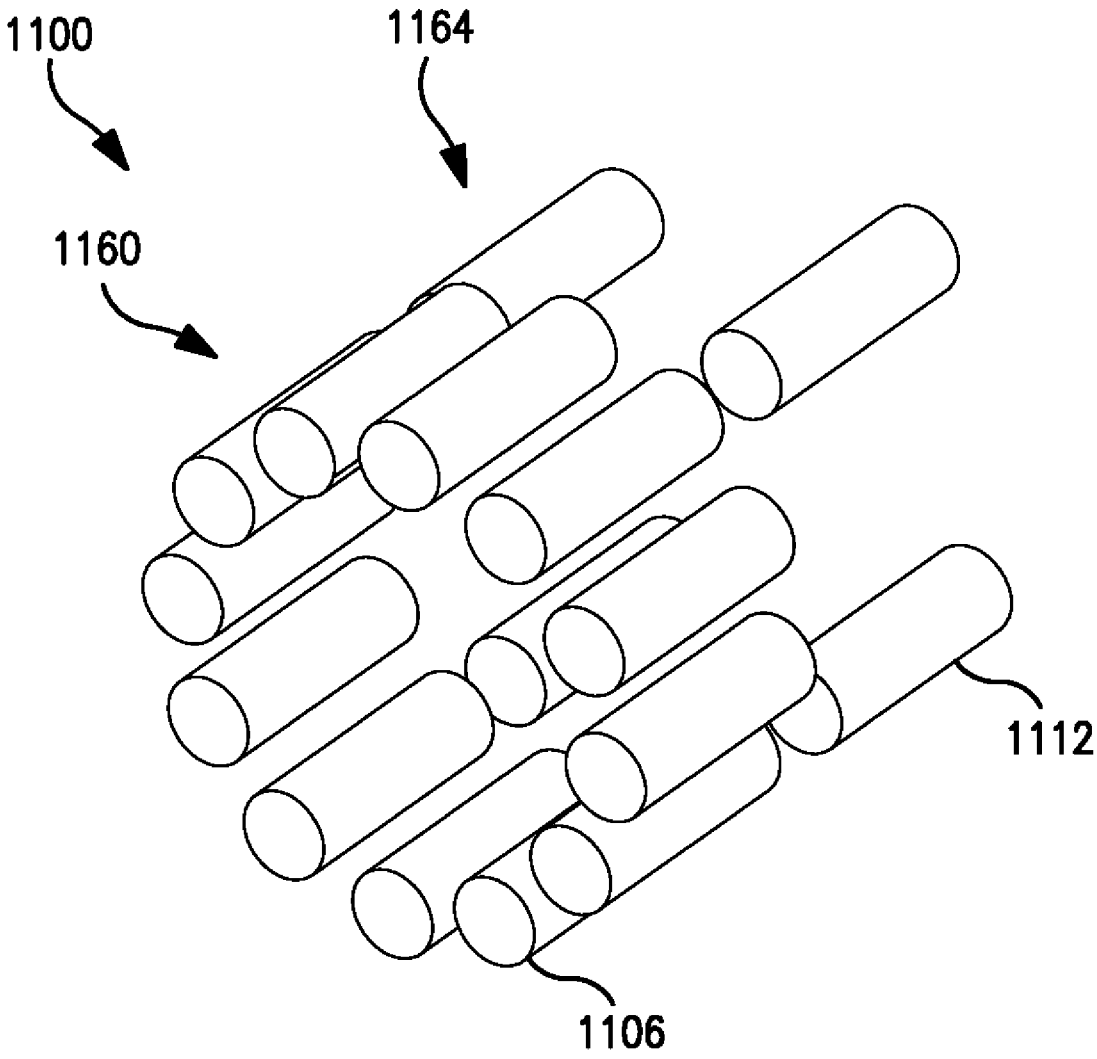
FIG. 11 is a perspective view of an example of an ion transport apparatus according to other implementations.

FIG. 11 is a perspective view of an example of an ion transport apparatus 1100 according to other implementations. The ion transport apparatus 1100 includes an ion entrance section 1160, an ion exit section 1164, and optionally one or more intermediate ion transport sections (not shown). The ion entrance section 1160 includes a first set 1106 of electrodes 1106 and the ion exit section 1164 includes a second set 1112 of electrodes. In this example, each section 1160, 1164 includes a different number of electrodes. The number of electrodes and the manner in which they are structured, and the manner in which RF signals are applied to the electrodes, are such that the ion transport apparatus 1100 generates a higher-order multipole RF field in the ion entrance section 1160 and a lower-order multipole RF field in the ion exit section 1164. By way of example and not by limitation in FIG. 11, the electrodes in each ion transport section 1160, 1164 are elongated along the longitudinal axis and circumferentially arranged about the longitudinal axis. The ion entrance section 1160 includes twelve electrodes 1106 and the ion exit section 1164 includes four electrodes 1112. One or more intermediate sections, if provided, could include a number of electrodes between four and twelve.

Figure 12A:
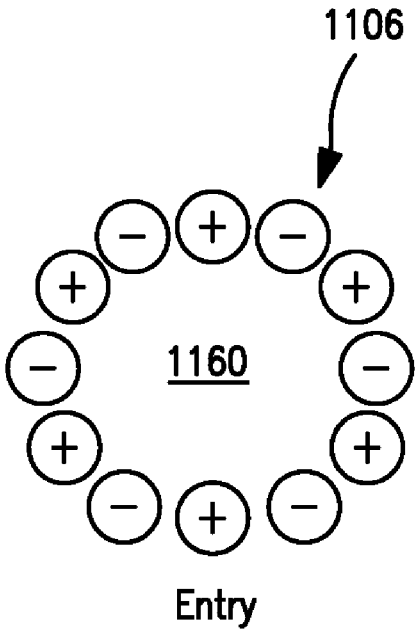
FIGS. 12A and 12B are schematic cross-sectional views of the electrode sets in the entrance section and exit section, respectively.
Figure 12B:
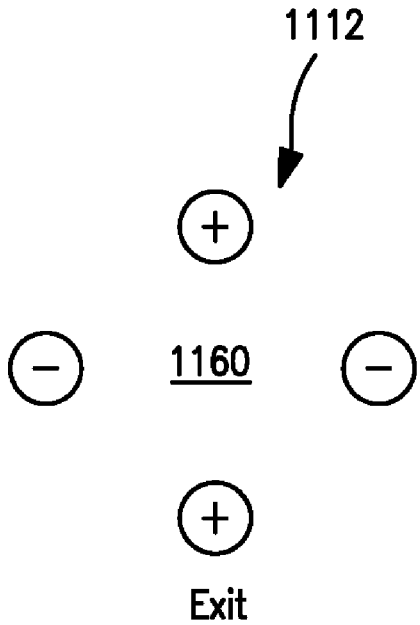

FIGS. 12A and 12B are schematic cross-sectional views of the electrode sets 1106, 1112 in the ion entrance section 1160 and the ion exit section 1164, respectively. FIGS. 12A and 12B also illustrate how the RF voltages are applied to the electrodes 1106, 1112 in each respective section 1160, 1164. As in the previous example, the RF voltage applied to each pair of opposing electrodes is 180° out of phase with the RF voltage applied to the adjacent electrodes on either side of that pair. As a result, the first electrode set 1106 applies a major dodecapole RF field in the ion entrance region 1160 and the second electrode set 1112 applies a predominant quadrupole RF field in the ion exit region 1164, and an ion beam through the ion transport apparatus 1100 will be convergent as described above. As in previous examples, one or more axially intermediate ion transport sections (not shown) could be added to apply one or more RF fields of an intermediate order relative to the RF fields applied in the ion entrance section 1160 and the ion exit section 1164. As in the example illustrated in FIGS. 9 to 10C, the ion transport apparatus 1100 is not limited to application of a dodecapole RF field and a quadrupole RF field; other types of RF fields may be utilized. Also as in the previous example, one or more electrode sets may be divided into groups of m electrodes. Thus, for example, the electrodes in first electrode set 1106 may be grouped so as to apply a hexapole field.

Figure 13:
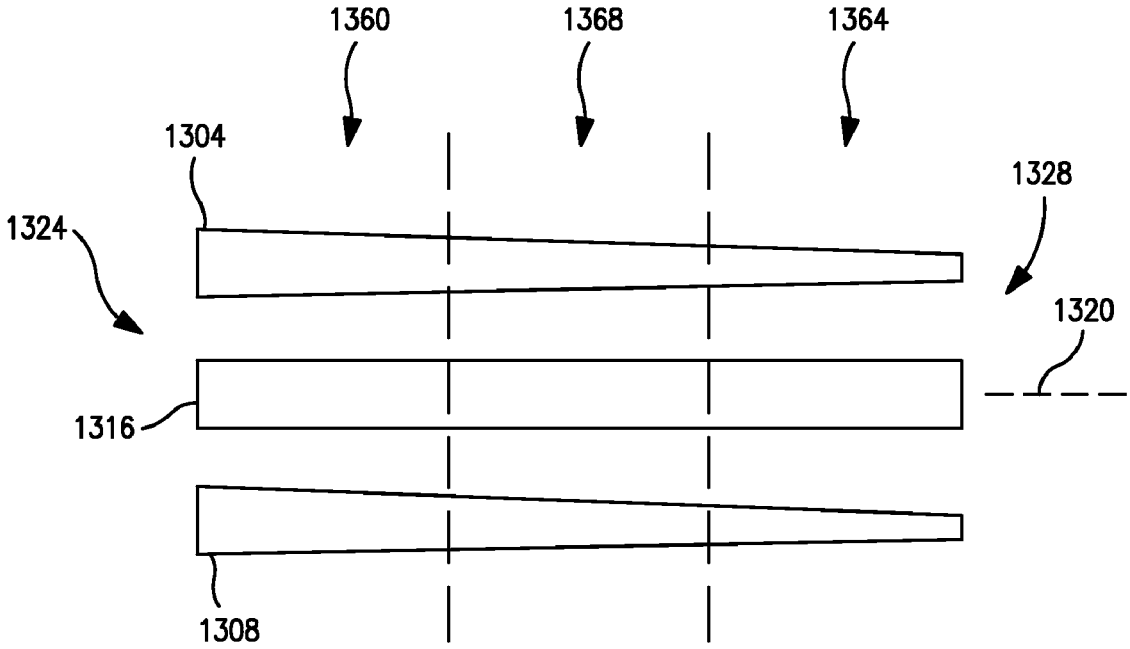
FIG. 13 is a side (length-wise) view of an example of ion transport apparatus according to other implementations.

FIG. 13 is a side (length-wise) view of an example of ion transport apparatus 1300 according to other implementations. The ion transport apparatus 1300 may include an ion entrance section 1360, an ion exit section 1364, and optionally one or more intermediate ion transport sections 1368, all axially positioned along a longitudinal axis 1320. The ion transport apparatus 1300 includes a plurality of electrodes elongated along the longitudinal axis 1320 and circumferentially arranged about the longitudinal axis 1320. For simplicity, only three electrodes are illustrated. The electrodes 1304, 1308, 1316 begin at an ion entrance end 1324 and extend through the sections to an ion exit end 1328. The number of electrodes and the manner in which they are structured, and the manner in which RF signals are applied to the electrodes, are such that the ion transport apparatus 1300 generates a higher-order multipole RF field at the ion entrance end 1324 (or in the ion entrance section 1360), a lower-order multipole RF field at the ion exit end 1328 (or in the ion exit section 1364), and another higher-order multipole RF field in the intermediate section 1368 (if provided) that is of lower order than the electrical field at the ion entrance end 1324 but higher order than the electrical field at the ion exit end 1328. In this example, the axially varying RF field is attained by some of the electrodes 1304, 1308 being of variable radius and hence variable cross-section. The reduction in cross-sectional area may be accomplished gradually in a tapered manner in the axial direction toward the ion exit end 1328. Thus, the cross-sectional areas of the tapered electrodes 1304, 1308 (in the transverse plane) are larger at the ion entrance end 1324 than at the ion exit end 1328. The reduction in cross-sectional area may alternatively be accomplished in a step-wise manner rather than gradual tapering, or a combination of tapered and stepped features may be implemented. At the ion entrance end 1324, the cross-sectional areas of the varying-radius electrodes 1304, 1308 may be the same as those of the constant-radius electrodes 1316.

Figure 14:
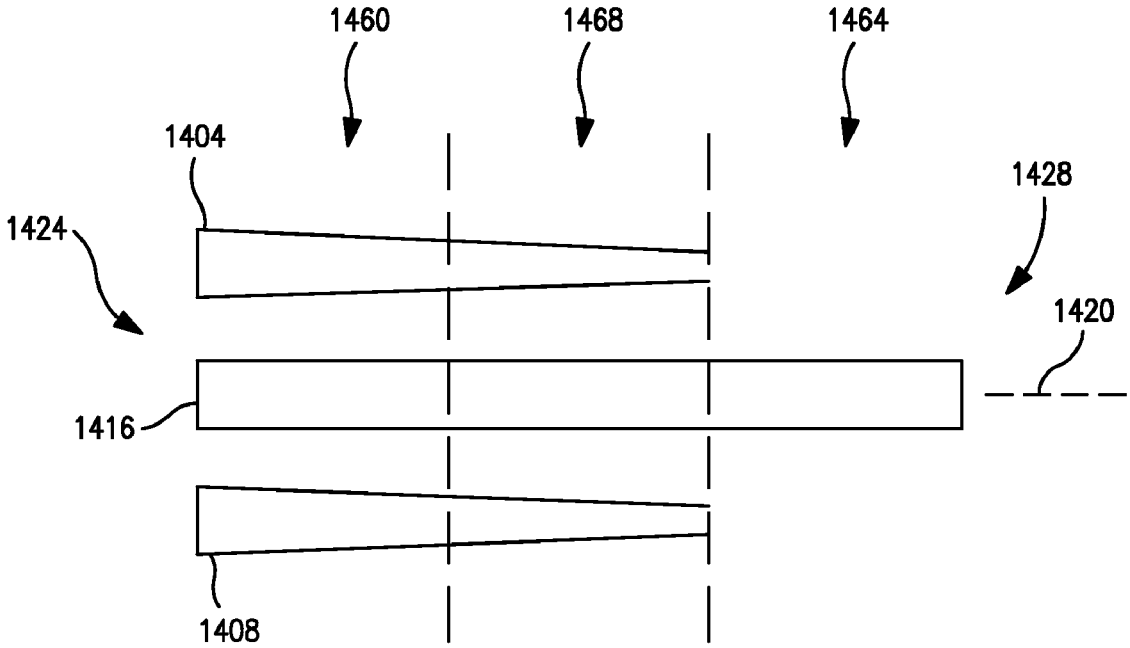
FIG. 14 is a side (length-wise) view of an example of ion transport apparatus according to other implementations.

FIG. 14 is a side (length-wise) view of an example of ion transport apparatus 1400 according to other implementations. The ion transport apparatus 1400 may include an ion entrance section 1460, an ion exit section 1464, and one or more intermediate ion transport sections 1468, all axially positioned along a longitudinal axis 1420. The ion transport apparatus 1400 includes a plurality of electrodes elongated along the longitudinal axis 1420 and circumferentially arranged about the longitudinal axis 1420. For simplicity, only three electrodes 1404, 1408, 1416 are illustrated. The electrodes 1404, 1408, 1416 begin at an ion entrance end 1424 and extend through the sections toward an ion exit end 1428. The number of electrodes and the manner in which they are structured, and the manner in which RF signals are applied to the electrodes, are such that the ion transport apparatus 1400 generates a higher-order multipole RF field at the ion entrance end 1424 (or in the ion entrance section 1460), a lower-order multipole RF field at the ion exit end 1428 (or in the ion exit section 1464), and another higher-order multipole RF field in the intermediate section 1468 (if provided) that is of lower order than the electrical field at the ion entrance end 1424 but higher order than the electrical field at the ion exit end 1428. In this example, the axially varying RF field is attained by some of the electrodes 1404, 1408 having varying cross-sectional areas that are reduced, such as by gradual tapering and/or in a step-wise manner, at one or more points in the axial direction toward the ion exit end 1428. Moreover, some or all of the varying-radius electrodes 1404, 1408 are shorter than the uniformly-sized electrodes 1416. Thus, both the uniformly-sized electrodes 1416 and the varying-radius electrodes 1404, 1408 begin at the ion entrance end 1424, but only the uniformly-sized electrodes 1416 may actually extend fully to the ion exit end 1428. The axial ends of the varying-radius electrodes 1404, 1408 opposite to the ion entrance end 1424 may be located, for example, at the end of the intermediate ion transport section 1468 as illustrated in FIG. 14. In this manner, the varying-radius electrodes 1404, 1408 exert no influence on the RF field applied to the ion exit section 1428. Alternatively, the varying-radius electrodes 1404, 1408 may extend partially (not shown) into the ion exit section 1464. In either case, the varying-radius electrodes will not contribute to the RF field at the ion exit end 1428.

Figure 15A:
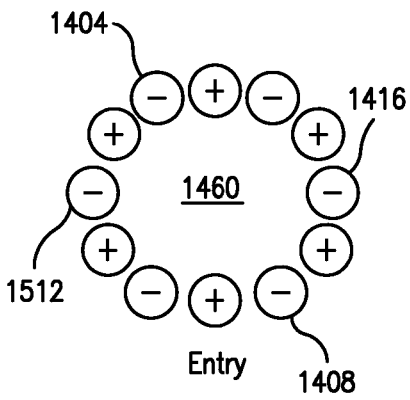
FIGS. 15A, 15B and 15C are schematic cross-sectional views of the electrode sets in the entrance section, intermediate section, and exit section, respectively, of the ion transport apparatus illustrated in FIG. 14.
Figure 15B:
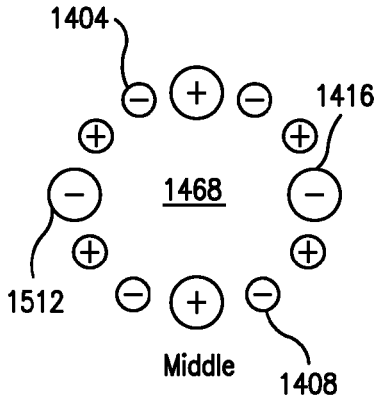
Figure 15C:
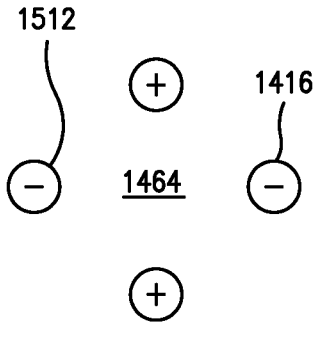

FIGS. 15A, 15B and 15C are schematic cross-sectional views of the electrode sets in the entrance section 1460, intermediate section 1468, and exit section 1464, respectively, of the ion transport apparatus 1400 illustrated in FIG. 14. FIGS. 15A, 15B and 15C also illustrate how the RF voltages are applied to the electrodes in each respective section 1460, 1464, 1468. In this example, there are twelve electrodes. Two opposing pairs of constant-radius electrodes (e.g., 1416, 1512) are positioned 90° from each other. Four opposing pairs of varying-radius electrodes (e.g., 1404, 1408) are positioned between the constant-radius electrodes 1416, 1512, such that two varying-radius electrodes are located circumferentially on either side of each constant-radius electrode. In the present example, cross-sectional areas of both the constant-radius electrodes 1416, 1512 and the varying-radius electrodes 1404, 1408 are equal at the ion entrance end, as shown in FIG. 15A. As shown in FIG. 15B, the cross-sectional areas of the varying-radius electrodes 1404, 1408 are less than cross-sectional areas of the constant-radius electrodes 1416, 1512 in the intermediate section 1468. As shown in FIG. 15C, the varying-radius electrodes 1404, 1408 are terminated before the ion exit section 1464 (or in other implementation, at least before the ion exit end), such that only the constant-radius electrodes 1416, 1512 are present in the ion exit section 1464 (or at least at the ion exit end). In this example, as indicated by "+" and "−" signs, the RF voltage applied to any given electrode, whether of constant or varying radius, is 180° out of phase with the RF voltage applied to the adjacent electrode on either side of that particular electrode. As a result of this configuration, the RF field applied will axially vary from a dodecapole field, to a multipole of intermediate order (e.g., hexapole), to a quadrupole.

In other implementations, the electrode set in the ion entrance section 1460 (FIG. 15A) and/or the intermediate section 1468 (FIG. 15B) may be grouped to apply other types of RF fields, as described above.

In the case of the ion transport apparatus 1300 illustrated in FIG. 13, the arrangement of electrodes and corresponding RF voltages may be similar to FIG. 15A at the ion entrance end 1324 and FIG. 15B at the ion exit end 1328. The RF will axially vary from a higher-order field (e.g., dodecapole) to a lower-order field (e.g., hexapole). At the ion exit end 1328, the radii of the varying-radius electrodes 1304, 1308 may, however, be small enough that a quadrupole field predominates at the ion exit end 1328 as in the case of the ion transport apparatus 1400 illustrated in FIG. 14.

Figure 16:
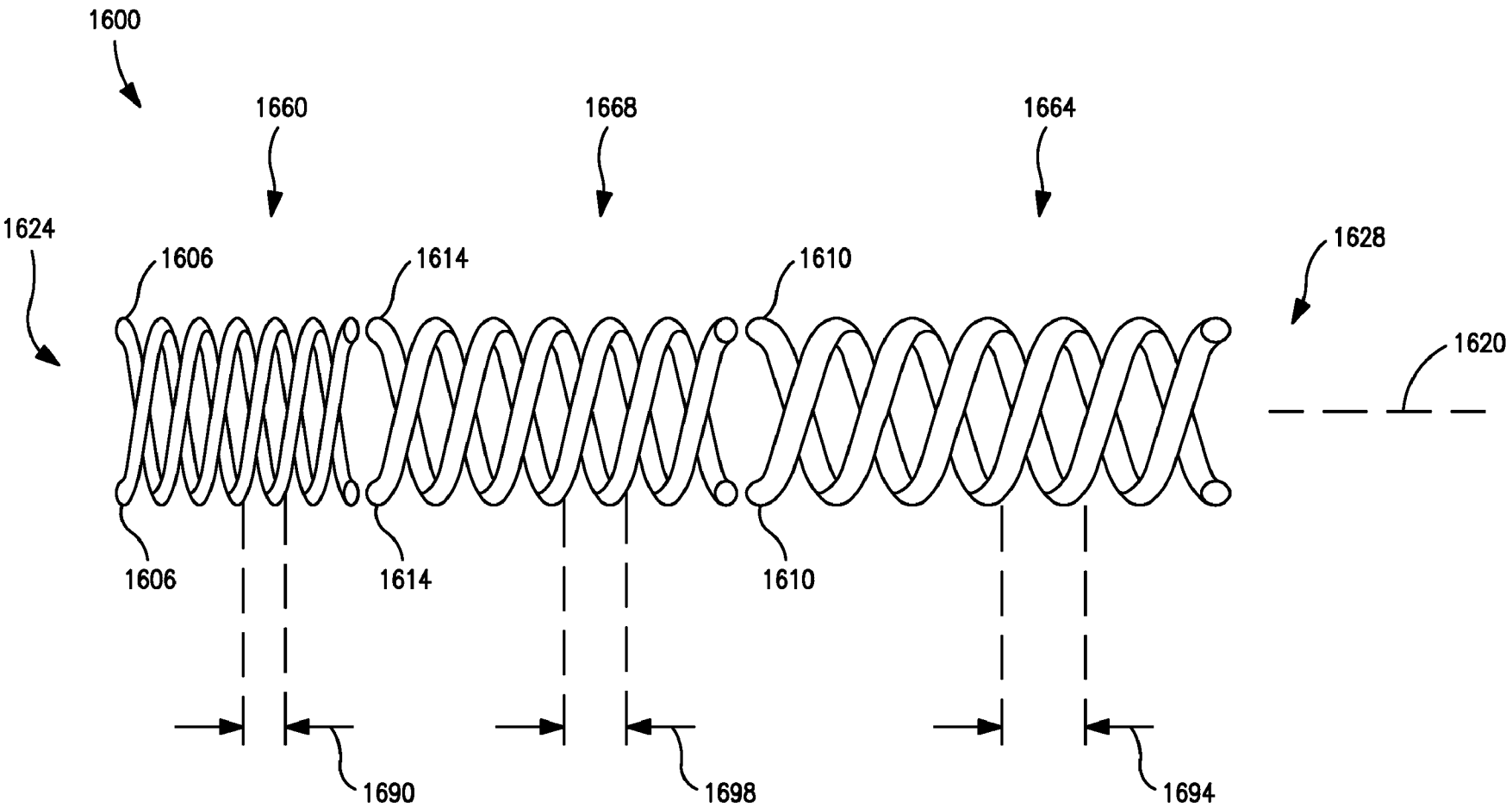
FIG. 16 is a side (length-wise) view of an example of ion transport apparatus according to other implementations.

FIG. 16 is a side (length-wise) view of an example of ion transport apparatus 1600 according to other implementations. The ion transport apparatus 1600 includes an ion entrance section 1660, an ion exit section 1664, and optionally one or more intermediate ion transport sections 1668, all axially positioned along a longitudinal axis 1620. The ion transport apparatus 1600 includes a plurality of electrodes, including first electrodes 1606 in the ion entrance section 1660, second electrodes 1610 in the ion exit section 1664, and third electrodes 1614 in the intermediate section 1668 if provided. The electrodes 1606, 1610, 1614 are arranged circumferentially about the longitudinal axis 1620 such that at least a portion of the electrodes 1606, 1610, 1614 are disposed at a radial distance from the longitudinal axis 1620 in the transverse plane. The first electrodes 1606 are spaced from each other by a first axial distance 1690 relative to the longitudinal axis 1620, and the second electrodes 1610 are spaced from each other by a second axial distance 1694 that is greater than the first axial distance 1690. The third electrodes 1614 (if provided) are spaced from each other by a third axial distance 1698 that is greater than the first axial distance 1690 but less than the second axial distance 1694. Accordingly, each section 1660, 1664, 1668 of the ion transport apparatus 1600 is characterized by electrodes of different axial spacing as compared to the other sections 1660, 1664, 1668. In the example specifically illustrated in FIG. 16, the axial spacing between electrodes in any given section 1660, 1664, 1668 is uniform over the extent of that section 1660, 1664, 1668. Alternatively, the axial spacing between the electrodes in one or more of the sections 1660, 1664, 1668 may vary as well, e.g., the axial spacing in a given section may increase in the direction through that section toward the ion exit end 1628.

In the example given in FIG. 16, the electrodes are provided in the form of helices coiled about the longitudinal axis 1620. Thus in this example, the axial spacing 1690, 1694, 1698 between electrodes corresponds to the helical pitch of the electrodes. Thus, the helical pitch increases in the direction of the ion exit end 1628 from one section to another and/or through individual sections. The helical pitch may be varied gradually or in steps. With the inner diameter of the helices fixed, the pseudo-potential well of the ion transport apparatus 1600 is varied gradually or in steps via the varying of the pitch in the direction toward the ion exit end 1628. In the present example, each section 1660, 1664, 1668 respectively includes two electrodes 1606, 1610, 1614 to which RF voltages are applied 180° out of phase. More than two electrodes, however, may be provided in a given section. By the illustrated configuration, the ion transport apparatus 1600 generates a higher-order multipole RF field in the ion entrance section 1660, a lower-order multipole RF field in the ion exit section 1664, and a second higher-order multipole RF field in the intermediate section 1668 (if provided) that is of lower order than the electrical field in the ion entrance section 1660 but higher order than the electrical field in the ion exit section 1664. As in other implementations described herein, the axially varying RF field results in a converging ion beam.

Figure 17:
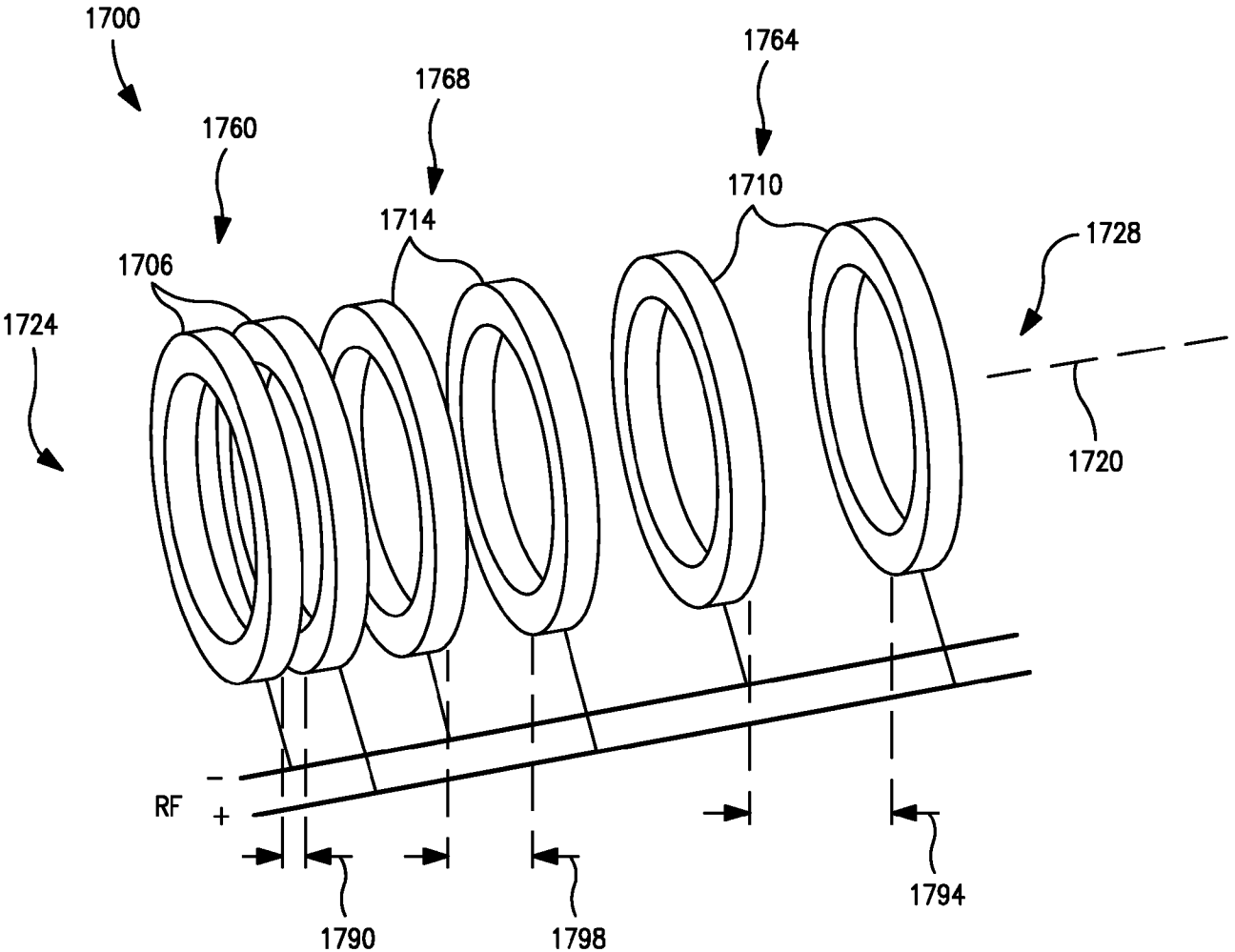
FIG. 17 is a perspective view of an example of ion transport apparatus according to other implementations.

FIG. 17 is a perspective view of an example of an ion transport apparatus 1700 according to other implementations. The ion transport apparatus 1700 includes an ion entrance section 1760, an ion exit section 1764, and optionally one or more intermediate ion transport sections 1768, all axially positioned along a longitudinal axis 1720. The ion transport apparatus 1700 includes a plurality of electrodes, including first electrodes 1706 in the ion entrance section 1760, second electrodes 1710 in the ion exit section 1764, and third electrodes 1714 in the intermediate section 1768 if provided. The electrodes 1706, 1710, 1714 are arranged circumferentially about the longitudinal axis 1720 such that at least a portion of the electrodes 1706, 1710, 1714 are disposed at a radial distance from the longitudinal axis 1720 in the transverse plane. The first electrodes 1706 are spaced from each other by a first axial distance 1790 relative to the longitudinal axis 1720, and the second electrodes 1710 are spaced from each other by a second axial distance 1794 greater than the first axial distance 1790. The third electrodes 1714 (if provided) are spaced from each other by a third axial distance 1798 that is greater than the first axial distance 1790 but less than the second axial distance 1794. Accordingly, each section 1760, 1764, 1768 of the ion transport apparatus 1700 is characterized by electrodes of different axial spacing as compared to the other sections 1760, 1764, 1768. In the example specifically illustrated in FIG. 17, the axial spacing between electrodes in any given section 1760, 1764, 1768 is uniform over the extent of that section 1760, 1764, 1768. Alternatively, the axial spacing between the electrodes in one or more of the sections 1760, 1764, 1768 may vary as well, e.g., the axial spacing in a given section may increase in the direction through that section toward the ion exit end 1728.

In the example given in FIG. 17, the electrodes are provided in the form of a series or stack of rings coaxially disposed about the longitudinal axis 1720 in the transverse plane. Thus in this example, the axial spacing 1790, 1794, 1798 between electrodes corresponds to the axial distance between adjacent rings. Thus, the axial distance increases in the direction of the ion exit end 1728 from one section to another and/or through individual sections. The axial distance may be varied gradually or in steps. With the inner diameter of the rings fixed, the pseudo-potential well of the ion transport apparatus 1700 is deepened gradually or in steps, and the ion radial distribution moves toward the longitudinal axis 1720, via the varying of the axial distance in the direction toward the ion exit end 1728. In the present example, each section 1760, 1764, 1768 respectively includes two electrodes 1706, 1710, 1714 to which RF voltages are applied 180° out of phase. More than two electrodes, however, may be provided in a given section. By the illustrated configuration, the ion transport apparatus 1700 generates a higher-order multipole RF field in the ion entrance section 1760, a lower-order multipole RF field in the ion exit section 1764, and a second higher-order multipole RF field in the intermediate section 1768 (if provided) that is of lower order than the electrical field in the ion entrance section 1760 but higher order than the electrical field in the ion exit section 1764. As in other implementations described herein, the axially varying RF field results in a converging ion beam.

Figure 18:
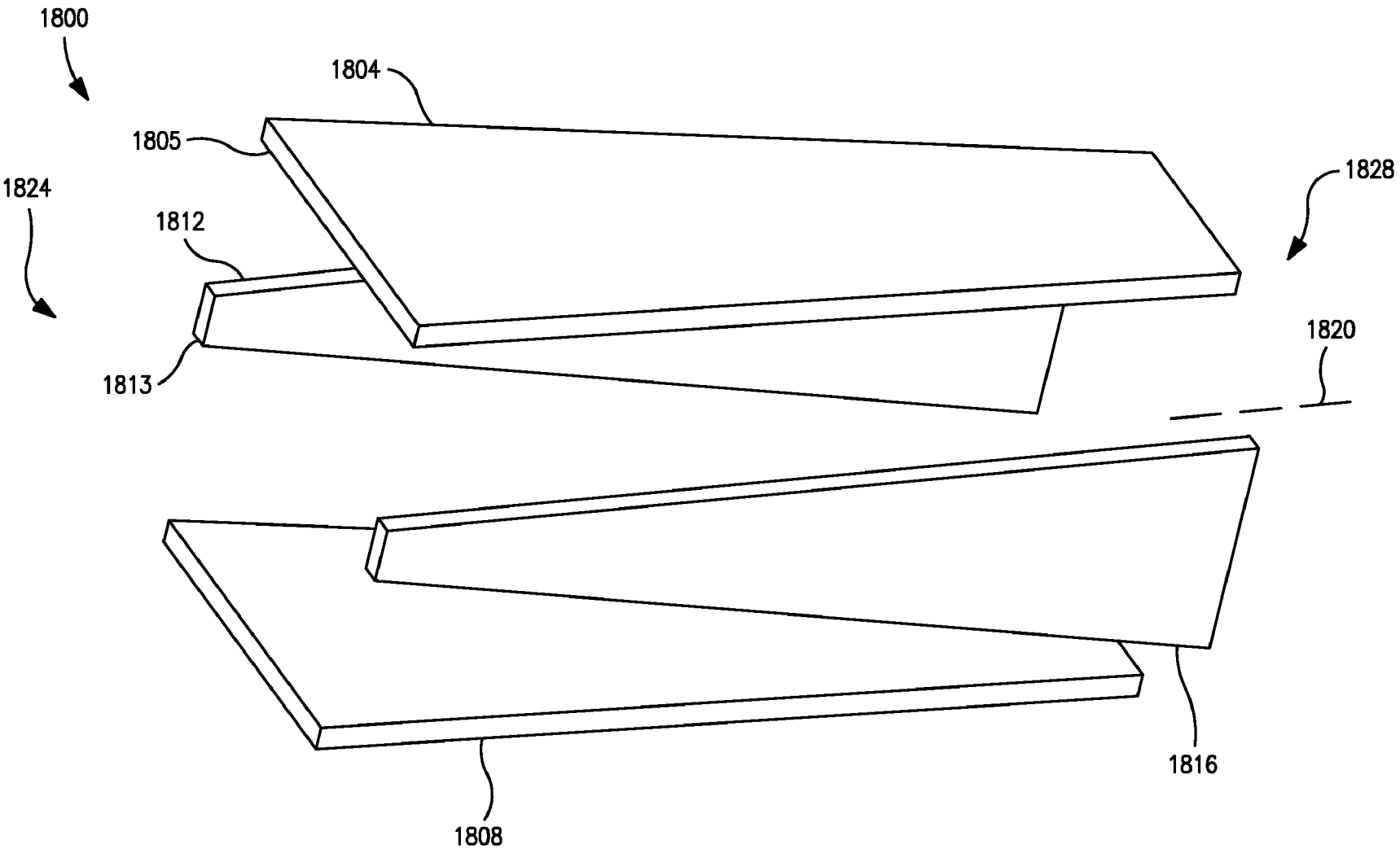
FIG. 18 is a perspective view of an example of an ion transport apparatus according to other implementations.

FIG. 18 is a perspective view of an example of an ion transport apparatus 1800 according to other implementations. The ion transport apparatus 1800 includes a plurality of electrodes elongated along a longitudinal axis 1820 and circumferentially spaced about the longitudinal axis 1820. In the illustrated example, the electrode set includes an opposing pair of first electrodes 1804, 1808 and an opposing pair of second electrodes 1812, 1816. The first electrodes 1804, 1808 and the second electrodes 1812, 1816 extend along the longitudinal axis 1820 from an ion entrance end 1824 to an ion exit end 1828. The first electrodes 1804, 1808 each include a first cross-sectional area 1805 in the transverse plane, and the second electrodes 1812, 1816 each include a second cross-sectional area 1813 in the transverse plane. The respective cross-sectional areas 1805, 1813 of the first electrodes 1804, 1808 and the second electrodes 1812, 1816 vary along the longitudinal axis 1820 either gradually (e.g., in a tapering manner, as in the illustrated example) or step-wise, or by a combination of tapering and stepped features. Thus, for the first electrodes 1804, 1808 the sizes of the first cross-sectional areas 1805 are different at the ion entrance end 1824 than at the ion exit end 1828, and for the second electrodes 1812, 1816 the sizes of the second cross-sectional areas 1813 are likewise different at the ion entrance end 1824 than at the ion exit end 1828. In the example specifically illustrated in FIG. 18, the first cross-sectional areas 1805 are larger at the ion entrance end 1824 than at the ion exit end 1828, and the second cross-sectional areas 1813 are smaller at the ion entrance end 1824 than at the ion exit end 1828. At the ion entrance end 1824, the first cross-sectional areas 1805 are greater than the second cross-sectional areas 1813. At the ion exit end 1828, the first cross-sectional areas 1805 may be equal or substantially equal to the second cross-sectional areas 1813. The RF voltages applied to the first electrodes 1804, 1808 are 180° out of phase with the RF voltages applied to the second electrodes 1812, 1816. By this configuration, the ion transport apparatus 1800 generates an RF field that varies from a major higher-order multipole RF field at the ion entrance end 1824 to a predominant quadrupole multipole RF field at the ion exit end 1828. As in other implementations described herein, the axially varying RF field results in a converging ion beam.

While in the above-described implementation the ion transport apparatus 1800 includes two pairs of opposing electrodes, other implementations may include additional electrodes, some or all of which having varying cross-sections. While in the above-described implementation the ion transport apparatus 1800 may be considered as including a single set of electrodes extending from the ion entrance end 1824 to the ion exit end 1828, other implementations may include additional sets of electrodes in distinct, axially spaced ion transport sections, with one or more electrodes in one or more of the ion transport sections having varying cross-sections. While in the above-described implementation the cross-sections 1805, 1813 of the electrodes are rectilinear in shape, in other implementations the cross-sections 1805, 1813 may have other types of polygonal or prismatic shapes or may be rounded (e.g., circular, elliptical, hyperbolic, etc.).

Figure 19:
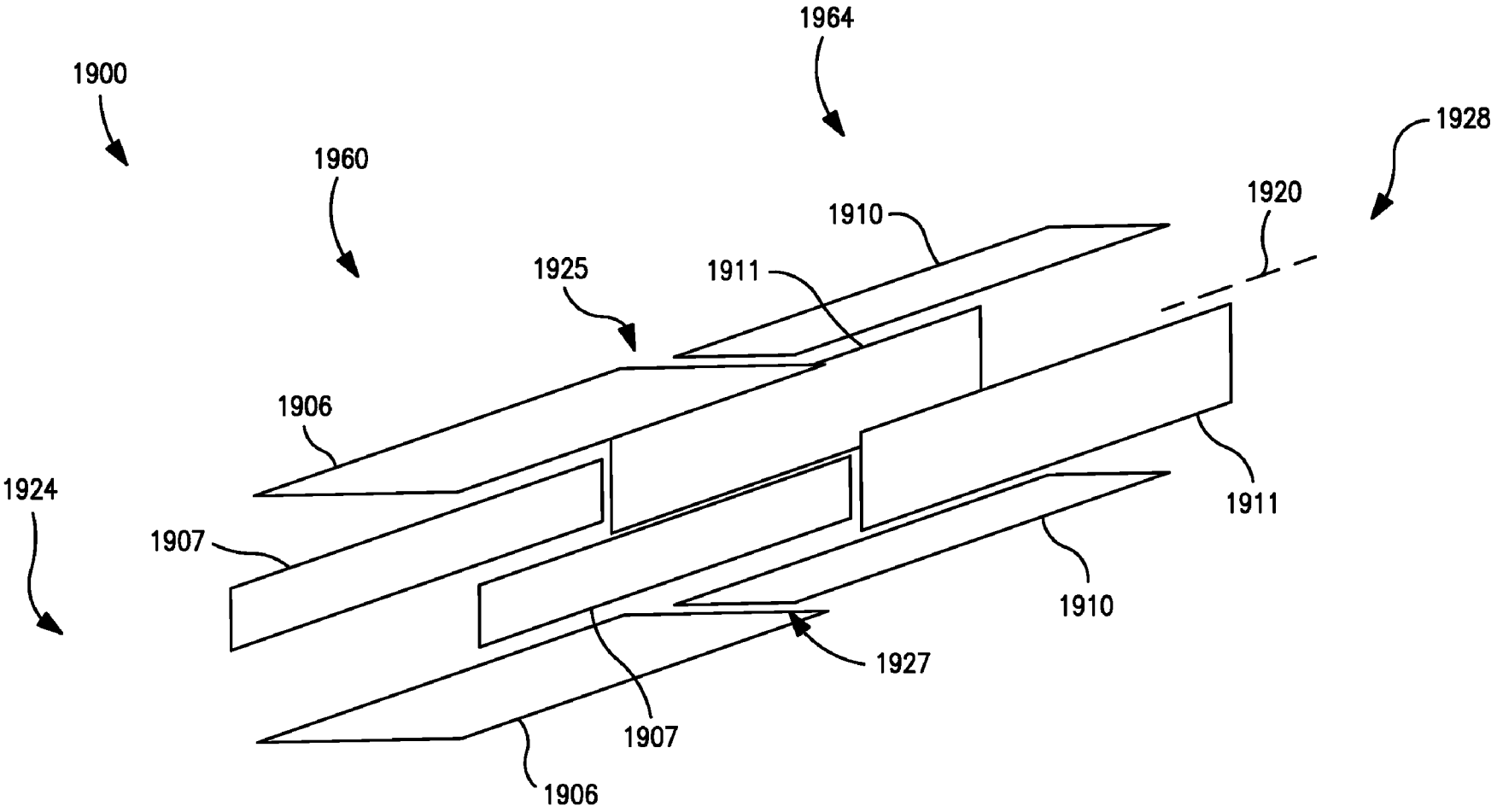
FIG. 19 is a perspective view of an example of an ion transport apparatus according to other implementations.

FIG. 19 is a perspective view of an example of an ion transport apparatus 1900 according to other implementations. The ion transport apparatus 1900 in FIG. 19 may be considered as variation of the ion transport apparatus 1800 in FIG. 18, but where the RF field varies from higher-order multipoles to a purer lower-order multipole over multiple segments or sets of electrodes (or multiple ion transport sections). The ion transport apparatus 1900 includes a first ion transport section (or ion entrance section) 1960 and a second ion transport section (or ion exit section) 1964 axially spaced from the first ion transport section 1960. Optionally, the ion transport apparatus 1900 additionally includes one or more intermediate sections (not shown) axially interposed between the first ion transport section 1960 and the second ion transport section 1964. The first ion transport section 1960 longitudinally extends from a first ion entrance end 1924 to a first ion exit end 1925, and the second ion transport section 1964 longitudinally extends from a second ion entrance end 1927 to a second ion exit end 1928. The first ion transport section 1960 includes a plurality of first electrodes and the second ion transport section 1964 includes a plurality of second electrodes, all of which are elongated along a longitudinal axis 1920 and circumferentially spaced about the longitudinal axis 1920. The first electrodes extend along the longitudinal axis 1920 from the first ion entrance end 1924 to the first ion exit end 1925, and the second electrodes extend along the longitudinal axis 1920 from the second ion entrance end 1927 to the second ion exit end 1928. In the illustrated example, the first electrode set includes an opposing pair of first electrodes 1906 and an opposing pair of second electrodes 1907, and the second electrode set includes an opposing pair of third electrodes 1910 and an opposing pair of fourth electrodes 1911. In the transverse plane, the first electrodes 1906 each include a first cross-sectional area, the second electrodes 1907 each include a second cross-sectional area, the third electrodes 1910 each include a third cross-sectional area, and the fourth electrodes 1911 each include a fourth cross-sectional area.

In the example given in FIG. 19, the respective cross-sectional areas of the electrodes may be uniform or substantially uniform along the longitudinal axis 1920 in a given ion transport section. However, the cross-sectional areas of some electrode pairs may differ from the cross-sectional areas of other electrode pairs. Thus, in the example specifically illustrated, the first cross-sectional areas (first electrodes 1906) are larger than the second cross-sectional areas (second electrodes 1907), and the first cross-sectional areas are larger than the third cross-sectional areas (the third electrodes 1910). The second cross-sectional areas are smaller than the fourth cross-sectional areas (fourth electrodes 1911). The third cross-sectional areas may be equal or substantially equal to the fourth cross-sectional areas. The RF voltages applied to the first electrodes 1906 are 180° out of phase with the RF voltages applied to the second electrodes 1907, and the RF voltages applied to the third electrodes 1910 are 180° out of phase with the RF voltages applied to the fourth electrodes 1911. By this configuration, the ion transport apparatus 1900 generates an RF field that varies from a major higher-order multipole RF field at the first ion entrance end 1924 (or in the first ion transport region 1960) to a predominant quadrupole multipole RF field at the second ion exit end 1928 (or in the second ion transport region 1964). As in other implementations described herein, the axially varying RF field results in a converging ion beam.

In other implementations, the respective cross-sectional areas of one or more electrodes in the first ion transport section 1960 and/or the second ion transport section 1964 may vary along the longitudinal axis 1920 either gradually (e.g., in a tapering manner) or step-wise or by a combination of tapering and stepped features, in a manner similar to that illustrated in FIG. 18. While in the above-described implementation the ion transport apparatus 1900 includes two pairs of opposing electrodes in each section 1960, 1964, other implementations may include additional electrodes, some or all of which having varying cross-sections. While in the above-described implementation the cross-sections of the electrodes are rectilinear in shape, in other implementations the cross-sections may have other types of polygonal or prismatic shapes or may be rounded (e.g., circular, elliptical, hyperbolic, etc.).

In other implementations, an ion transport apparatus may include various combinations of features and aspects described in conjunction with FIGS. 1-19. Moreover, the ion transport apparatus illustrated in any of FIGS. 1-19 may represent a portion or section of a larger ion transport apparatus (not shown) that includes one or more additional sections positioned upstream and/or downstream of the illustrated ion transport apparatus. These additional ion transport sections may also be configured according to any of the implementations described above, but alternatively may be configured according to conventional designs without converging ion beams.

In the various implementations described above and illustrated in FIGS. 1-19, the ion transport apparatus is discussed primarily in the context of an RF-only ion guide, with axial DC potentials added as needed to modulate ion kinetic energy in the axial direction. It will be understood, however, that the ion transport apparatus may function as other types of ion processing apparatus. For example, the ion transport apparatus may be utilized as a collision cell for fragmenting ions, such as by directing an appropriate background gas to the convergent ion beam in the interior space circumscribed by the electrodes. As another example, the ion transport apparatus may be utilized as a mass filter or sorter that passes only ions within a desired range of mass-to-charge (or m/z) ratios, such as by superposing an appropriate DC voltage U on the RF voltage V that drives the two-dimensional RF field.

An ion transport apparatus provided in accordance with any of the implementations disclosed herein may form a part of an ion processing system that includes other ion-processing devices. For example, the ion processing system may generally include one or more upstream devices and/or one or more downstream devices. The ion processing system may be a mass spectrometry (MS) system (or apparatus, device, etc.) configured to perform a desired MS technique (e.g., single-stage MS, tandem MS or MS/MS, $MS^n$, etc.). Thus, as a further example, the upstream device may be an ion source and the downstream device may be an ion detector, and additional devices may be included such as ion storage or trapping devices, mass sorting or analyzing devices, collision cells or other fragmenting devices, ion optics and other ion guiding devices, etc. Thus, for example, the ion guide may be utilized before a mass analyzer (e.g., as a Q0device), or itself as an RF/DC mass analyzer, or as a collision cell positioned after a first mass analyzer and before a second mass analyzer. Accordingly, the ion guide may be evacuated, or may be operated in a regime where collisions occur between ions and gas molecules (e.g., as a Q0 device in a high-vacuum GC/MS, or a Q0 device in the source region of an LC/MS, or a Q2 device, etc.).

In the various implementations described above and illustrated in FIGS. 1-19, the electrodes of the ion transport apparatus have been configured to provide an ion-guiding interior space elongated along a straight longitudinal axis, thereby resulting in a straight (albeit converging) ion beam. It will be understood, however, that the longitudinal axis need not be a straight axis but rather may be a curved axis. This may be accomplished by configuring the electrodes appropriately. A curved, converging ion beam is realized as a result. Generally, a curved ion guide is one in which the ion axis along which the ions pass is a curved path rather than a straight path. A curved ion guide is often desirable for implementation in ion processors such as mass spectrometers because the curved ion guide can improve the sensitivity and robustness of the mass spectrometer. A primary advantage of the curved ion guide in such a context is that it provides a line-of-sight separation of the neutral noise, large droplet noise, or photons from the ions, thereby preventing the neutral components from reaching the more sensitive parts of the ion optics and ion detector. Moreover, the curved ion guide enables the folding or turning of ion paths and allows smaller footprints in the associated instruments.

As an example, a curved ion transport apparatus may impart a smooth 90° turn to the ion path. One or more additional curved ion transport sections may be added to further modify the ion path. These additional ion transport sections may also be configured as circular sectors but alternatively may follow linear paths or other types of non-circular paths. Thus, one or more ion transport sections may be utilized to provide any desired path for an ion beam focused thereby. Thus, in another non-illustrated example, the ion transport apparatus may be shaped so as to provide a 180-degree turn in the focused ion path, i.e., a U-shaped ion path, with the use of one or more appropriately shaped ion transport sections. In another example, the "legs" of the U-shaped path may be extended by providing linear ion guide sections adjacent to the ion inlet and the ion outlet of the U-shaped ion guide. In another example, two 90-degree ion transport sections may be positioned adjacent to one another to realize the 180-degree turn in the ion path. In another example, two similarly shaped ion transport sections may be positioned adjacent to one another such that the radius of curvature of one section is directed oppositely to that of the other ion section, thereby providing an S-shaped ion path. Persons skilled in the art will appreciate that various other configurations may be derived from the present teachings.

It will be understood that the methods and apparatus described in the present disclosure may be implemented in an ion processing system such as an MS system as generally described above by way of example. The present subject matter, however, is not limited to the specific ion processing systems illustrated herein or to the specific arrangement of circuitry and components illustrated herein. Moreover, the present subject matter is not limited to MS-based applications, as previously noted.

In general, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation-the invention being defined by the claims.

What is claimed is:

1. An ion transport apparatus, comprising:

an ion entrance end;

an ion exit end disposed at a distance from the ion entrance end along a longitudinal axis;

an ion entrance section extending along the longitudinal axis from the ion entrance end toward the ion exit end;

an ion exit section extending along the longitudinal axis from the ion exit end toward the ion entrance end; and a plurality of electrodes arranged along the longitudinal axis wherein at least portions of the electrodes are disposed at a radial distance in a transverse plane orthogonal to the longitudinal axis, the plurality of electrodes including a plurality of first electrodes circumscribing an interior space in the ion entrance section and a plurality of second electrodes circumscribing an interior space in the ion exit section, wherein the plurality of electrodes is configured for applying an RF electrical field that varies along the longitudinal axis such that at the ion entrance end, the RF electrical field comprises a first RF electrical field comprising a major first multipole component of $2n_1$ poles where $n_1 \geqq 3/2$, and at the ion exit end the RF electrical field comprises a second RF electrical field comprising predominantly a second multipole component of $2n_2$ poles where $n_2 \geqq 3/2$ and $n_2 < n_1$.

2. The ion transport apparatus of claim 1, wherein the first electrodes are elongated along the longitudinal axis and spaced circumferentially about the longitudinal axis, and the second electrodes are elongated along the longitudinal axis and spaced circumferentially about the longitudinal axis.

3. The ion transport apparatus of claim 2, wherein:

a number of first electrodes equals a number of second electrodes;

the plurality of first electrodes is divided into groups of $m_1$ first electrodes, each group of $m_1$ first electrodes is adjacent to two other groups of $m_1$ first electrodes, the number $m_1$ of first electrodes in each group is $m_1 \geqq 1$;

the plurality of second electrodes is divided into groups of $m_2$ second electrodes, each group of $m_2$ second electrodes is adjacent to two other groups of $m_2$ second electrodes, and $m_2 > m_1$; and further comprising circuitry configured for applying a first RF voltage to the first electrodes to generate the first RF electrical field and a second RF voltage to the second electrodes to generate the second RF electrical field, wherein the first RF voltage applied to each group of first electrodes is 180 degrees out of phase with the first RF voltage applied to the adjacent groups of first electrodes, and the second RF voltage applied to each group of second electrodes is 180 degrees out of phase with the second RF voltage applied to the adjacent groups of second electrodes.

4. The ion transport apparatus of claim 2, wherein the number of first electrodes is greater than the number of second electrodes.

5. The ion transport apparatus of claim 4, wherein the plurality of first electrodes is divided into groups of $m_1$ first electrodes, each group of $m_1$ first electrodes is adjacent to two other groups of $m_1$ first electrodes, and the number $m_1$ of first electrodes in each group is $m_1 \geqq 1$,and further comprising circuitry configured for applying a first RF voltage to the first electrodes to generate the first RF electrical field and a second RF voltage to the second electrodes to generate the second RF electrical field, wherein the first RF voltage applied to each group of first electrodes is 180 degrees out of phase with the first RF voltage applied to the adjacent groups of first electrodes, and the second RF voltage applied to each second electrode is 180 degrees out of phase with the second RF voltage applied to the adjacent second electrodes.

6. The ion transport apparatus of claim 1, wherein the first electrodes are spaced from each other by a first axial distance relative to the longitudinal axis, and the second electrodes are spaced from each other by a second axial distance relative to the longitudinal axis greater than the first axial distance.

7. The ion transport apparatus of claim 6, wherein at least one of the first axial distance and the second axial distance is constant along the longitudinal axis.

8. The ion transport apparatus of claim 6, wherein at least one of the first axial distance and the second axial distance increases along the longitudinal axis.

9. The ion transport apparatus of claim 6, wherein the first electrodes and the second electrodes are helically coiled around the longitudinal axis, the first axial distance is a first helical pitch of the first electrodes, and the second axial distance is a second helical pitch of the second electrodes.

10. The ion transport apparatus of claim 6, wherein the first electrodes comprise two or more first rings oriented in a transverse plane orthogonal to the longitudinal axis, the first axial distance is a first axial spacing between adjacent first rings, the second electrodes comprise two or more second rings oriented in the transverse plane, and the second axial distance is a second axial spacing between adjacent second rings.

11. The ion transport apparatus of claim 1, wherein:

the first electrodes are elongated along the longitudinal axis and comprise a first pair of electrodes oppositely spaced from each other relative to the longitudinal axis and a second pair of electrodes oppositely spaced from each other relative to the longitudinal axis;

the second electrodes are elongated along the longitudinal axis and comprise a third pair of electrodes oppositely spaced from each other relative to the longitudinal axis and a fourth pair of electrodes oppositely spaced from each other relative to the longitudinal axis, wherein:

each electrode of the first pair has a first cross-sectional area in the transverse plane, each electrode of the second pair has a second cross-sectional area in the transverse plane, each electrode of the third pair has a third cross-sectional area in the transverse plane, and each electrode of the fourth pair has a fourth cross-sectional area in the transverse plane;

at the ion entrance end, the first cross-sectional area is greater than the second cross-sectional area;

at the ion exit end, the third cross-sectional area is equal to the fourth cross-sectional area;

the first cross-sectional area at the ion entrance end is greater than the third cross-sectional area at the ion exit end; and the second cross-sectional area at the ion entrance end is less than the fourth cross-sectional area at the ion exit end.

12. The ion transport apparatus of claim 11, wherein the first cross-sectional area is uniform along the longitudinal axis, the second cross-sectional area is uniform along the longitudinal axis the third cross-sectional area is uniform along the longitudinal axis, and the fourth cross-sectional area is uniform along the longitudinal axis.

13. The ion transport apparatus of claim 11, wherein at least one of the first cross-sectional area, the second cross-sectional area, the third cross-sectional area and the fourth cross-sectional area is different at the ion entrance end than at the ion exit end.

14. The ion transport apparatus of claim 1, further comprising an intermediate ion transport section interposed between the ion entrance section and the ion exit section, wherein the plurality of electrodes further comprises a plurality of third electrodes circumscribing an interior space in the intermediate ion transport section, and the plurality of third electrodes is configured for applying a third RF electrical field comprising a major third multipole component of $2n_3$ poles where $n_3 \geqq 3/2$ and $n_1 > n_3 > n_2$.

15. An ion transport apparatus, comprising:

an ion entrance end;

an ion exit end disposed at a distance from the ion entrance end along a longitudinal axis;

a plurality of electrodes arranged along the longitudinal axis from the ion entrance end toward the ion exit end and circumscribing an interior space of the ion transport apparatus, wherein:

at least some of the electrodes have a cross-sectional area in a transverse plane orthogonal to the longitudinal axis wherein the cross-sectional area is different at the ion entrance end than at an opposite axial end of the at least some electrodes;

the plurality of electrodes is configured for applying an RF electrical field that varies along the longitudinal axis such that at the ion entrance end, the RF electrical field comprises a major first multipole component of $2n_1$ poles where $n_1 \geqq 3/2$, and at the ion exit end the RF electrical field comprises predominantly a second multipole component of $2n_2$ poles where $n_2 < 3/2$ and $n_2 < n_1$.

16. The ion transport apparatus of claim 15, wherein:

the plurality of electrodes comprises a first pair of electrodes oppositely spaced from each other relative to the longitudinal axis and a second pair of electrodes oppositely spaced from each other relative to the longitudinal axis;

each electrode of the first pair and the second pair extends from the ion entrance end to the ion exit end and has a first cross-sectional area in the transverse plane, the first cross-sectional area being uniform over an entire length of the electrode; and the at least some electrodes comprise a plurality of second electrodes, each second electrode having a second cross-sectional area in the transverse plane, each second cross-sectional area being equal to the first cross-sectional area at the ion entrance end and being decreased at an opposite axial end of the second electrode.

17. The ion transport apparatus of claim 16, wherein the second electrodes are shorter than the first electrodes whereby the second electrodes are absent at the ion exit end.

18. The ion transport apparatus of claim 15, wherein:

the plurality of electrodes comprises a first pair of electrodes oppositely spaced from each other relative to the longitudinal axis and a second pair of electrodes oppositely spaced from each other relative to the longitudinal axis;

each electrode of the first pair has a first cross-sectional area in the transverse plane, and the first cross-sectional area is greater at the ion entrance end than at the ion exit end;

each electrode of the second pair has a second cross-sectional area in the transverse plane, and the second cross-sectional area is less at the ion entrance end than at the ion exit end;

at the ion entrance end, the second cross-sectional area is less than the first cross-sectional area; and at the ion exit end, the second cross-sectional area is equal to the first cross-sectional area.

19. A method for transporting ions, the method comprising:

admitting the ions into an interior space of an ion transport apparatus at an axial ion entrance end thereof, the ion transport apparatus comprising a plurality of electrodes arranged along a longitudinal axis from the axial ion entrance end toward an axial ion exit end, wherein the plurality of electrodes surrounds the interior space in a transverse plane orthogonal to the longitudinal axis; and constraining radial motions of the ions in the transverse plane to a converging ion beam that extends along the longitudinal axis from a large ion beam cross-section at the ion entrance end to a small ion beam cross-section at the ion exit end, by applying an RF electrical field that varies along the longitudinal axis such that at the ion entrance end, the RF electrical field comprises a major first multipole component of $2n_1$ poles where $n_1 \geqq 3/2$, and at the ion exit end the RF electrical field comprises predominantly a second multipole component of $2n_2$ poles where $n_2 \geqq 3/2$ and $n_2 < n_1$.

20. The method of claim 19, wherein the plurality of electrodes comprises a first electrode set and a second electrode set axially spaced from the first electrode set along the longitudinal axis, and applying the RF electrical field comprises applying a first RF electrical field to the first electrode set and a second RF electrical field to the second electrode set, the first RF electrical field comprising at least the first multipole component and the second RF electrical field comprising at least the second multipole component.

* * * * *

UNITED STATES PATENT AND TRADEMARK OFFICE

CERTIFICATE OF CORRECTION

PATENT NO. : 8,124,930 B2
APPLICATION NO. : 12/479614
DATED : February 28, 2012
INVENTOR(S) : Mingda Wang It is certified that error appears in the above-identified patent and that said Letters Patent is hereby corrected as shown below:

In the Claims:

In column 22, line 16, in Claim 5, delete "$m_1 \geqq 1$,and" and insert -- $m_1 \geqq 1$, and --, therefor.

In column 23, line 52, in Claim 15, delete "$n_2 < 3/2$" and insert -- $n_2 \geqq 3/2$ --, therefor.

Signed and Sealed this
Tenth Day of July, 2012

David J. Kappos

David J. Kappos
*Director of the United States Patent and Trademark Office*